US008118003B2

(12) United States Patent
Nishida et al.

(10) Patent No.: US 8,118,003 B2
(45) Date of Patent: Feb. 21, 2012

(54) VALVE OPERATING SYSTEM

(75) Inventors: Toru Nishida, Akashi (JP); Kazuki Nagasawa, Akashi (JP); Yoshio Watanabe, Kakogawa (JP); Yoji Fukami, Kakogawa (JP); Toshiyuki Yanamoto, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 412 days.

(21) Appl. No.: 12/402,014

(22) Filed: Mar. 11, 2009

(65) Prior Publication Data

US 2009/0241881 A1 Oct. 1, 2009

(30) Foreign Application Priority Data

Mar. 12, 2008 (JP) ..... 2008-063063
Apr. 18, 2008 (JP) ..... 2008-108948
Jul. 10, 2008 (JP) ..... 2008-180294

(51) Int. Cl.
*F01L 1/34* (2006.01)

(52) U.S. Cl. ..... 123/90.16; 123/90.39

(58) Field of Classification Search ..... 123/90.15, 123/90.16, 90.39; 74/559, 569
See application file for complete search history.

(56) References Cited

U.S. PATENT DOCUMENTS 3,641,988 A 2/1972 Torazza et al.
7,311,073 B1 12/2007 Kim et al.
2001/0054403 A1* 12/2001 Fujii et al. ..... 123/90.15

FOREIGN PATENT DOCUMENTS

| | | | |
|---|---|---|---|
| DE | 102004057439 | A1 | 6/2006 |
| EP | 1666701 | A1 | 6/2006 |
| EP | 1726792 | A2 | 11/2006 |
| JP | 06074010 | | 3/1994 |
| JP | 11036833 | | 2/1999 |
| JP | 2005180232 | | 7/2005 |
| WO | 2005052326 | A1 | 6/2005 |
| WO | 2007138451 | A1 | 12/2007 |

OTHER PUBLICATIONS

ISA European Patent Office, Search Report of 09 00 3573, May 11, 2010, 8 Pages.

* cited by examiner

*Primary Examiner* — Zelalem Eshete
(74) *Attorney, Agent, or Firm* — Alleman Hall McCoy Russell & Tuttle LLP

(57) ABSTRACT

A pivot cam mechanism included in a valve operating system is configured such that a coupling pin is supported at a pivot member in a position closer to a camshaft than a control shaft, and the pivot member and the driven member are integrally pivotable according to the rotation of the drive cam while changing relative attitudes of the driven member and the pivot member. Positions and shapes of the drive cam, the driven member, and the pivot member are designed so that a valve maximum acceleration point at which an acceleration of a valve body is at a maximum is located in a front part of a valve acceleration period in which the acceleration of the valve body has a positive value while the drive cam is rotating once.

21 Claims, 28 Drawing Sheets

VALVE OPERATING SYSTEM

TECHNICAL FIELD

The present invention relates to a valve operating system of an engine which is configured to change lift characteristics of a valve for opening and closing a region between a combustion chamber and an intake port or a region between the combustion chamber and an exhaust port.

BACKGROUND ART

An engine includes a valve (intake valve, exhaust valve) for opening and closing a region between a combustion chamber and an intake port or a region between the combustion chamber and an exhaust port. The engine is configured to control lift characteristics of the valve such as opening and closing timings and opening and closing amounts (lift amount of valve) to change its characteristics. Also, a valve operating system is proposed to change lift characteristics of the valve depending on the engine (e.g., see Japanese Laid-Open Patent Application Publication No. 2005-180232 (especially see FIGS. 1 and 2), Japanese Laid-Open Patent Application Publication No. Hei. 06-74010 (especially see FIGS. 11 and 12)).

According to the disclosure of Japanese Laid-Open Patent Application Publication No. 2005-180232, a first arm member, a pivot roller portion and a locker arm are provided between a drive cam and a valve. During rotation of the drive cam, the pivot roller portion and the first arm member rotate respectively around separate axes, and the locker arm, which is pressed by the first arm member, is pivoted around a base end portion thereof such that a tip end portion thereof moves vertically, causing the valve to reciprocate. On the other hand, when a control shaft is angularly displaced around its center axis, the attitude of the pivot roller portion with respect to the first arm member is changed, changing the lift characteristics of the valve.

According to the structure disclosed in Japanese Laid-Open Patent Application Publication No. Hei 06-74010, a pivot arm and a pivot cam are provided between a drive cam and a valve. A roller is rotatably supported in close proximity to a tip end of the pivot arm and is configured to contact the drive cam. When the drive cam rotates, a driving power is transmitted to the pivot arm and the pivot cam via the roller, and the pivot cam presses the valve, causing the valve to reciprocate.

In the structure disclosed in Japanese Laid-Open Patent Application Publication No. 2005-180232, the pivot roller portion, the first am member and others are disposed between the drive cam and the valve in addition to the locker arm and they are all pivoted during the reciprocation of the valve as described above. Therefore, an inertia moment of movable members increases. If the inertia moment increases, then it may be difficult to attain a high engine speed, or a wear amount of slidable portions may increase. Also, in the structure disclosed in patent document 2, during the rotation of the drive cam, a drive member, a pivot camshaft, a support shaft, and others are pivoted in addition to a follower and the pivot cam, increasing the inertia moment of the movable members.

The structure of Japanese Laid-Open Patent Application Publication No. Hei. 06-74010 is directed to reducing a PV value (i.e., a multiplication value of a surface pressure (P) and a sliding speed (V) at contact portions) at the time of contact between the pivot arm and the drive cam by causing the pivot arm and the drive cam to contact with the roller interposed between them. However, since the inertia moment of the movable members increases because of a weight of the roller, the maximum value of the PV value which occurs while the drive cam is rotating once can not be sufficiently reduced.

Accordingly, an object of the present invention is to provide a valve operating system which is capable of reducing an inertia moment in movable members of the valve operating system. Another object of the present invention is to provide a valve operating system which is capable of simplifying a structure for changing a phase between a driven member and a pivot cam while reducing a PV value between the drive cam and the driven member.

SUMMARY OF THE INVENTION

In view of the aforesaid circumstances, the present invention has been made, and a valve operating system of an engine which is configured to change lift characteristics of a valve for opening and closing a port for air-intake or for air-exhaust, according to the present invention, comprising: a drive cam provided at a camshaft which is configured to rotate in association with a crankshaft; and a pivot cam mechanism which is provided between the drive cam and the valve; wherein the pivot cam mechanism includes: a pivot member which is angularly displaceably supported by a first support shaft and includes a pressing portion which is configured to press the valve by the angular displacement of the pivot member around the first support shaft, the pivot member causing the valve to reciprocate; and a driven member which is angularly displaceably supported by a second support shaft provided at the pivot member eccentrically from the first support shaft and has a sliding contact surface which is configured to slidably contact the drive cam, the driven member being configured to transmit displacement of the drive cam to the pivot member; and wherein the pivot cam mechanism causes the driven member to be angularly displaced around the second support shaft to change relative attitudes of the driven member and the pivot member and causes the pivot member and the driven member to be integrally pivoted around the first support shaft according to rotation of the drive cam.

In such a configuration, since the members which move during the rotation of the drive cam (i.e., reciprocation of the valve) are reduced in number, an increase in an inertia moment is suppressed. By changing the relative attitudes of the driven member and the pivot member according to the angular displacement of the driven member around the second support shaft, the way to transmit the driving power from the drive cam to the valve can be changed so that the lift characteristics of the valve can be changed.

The second support shaft may be eccentric to be closer to the camshaft than the first support shaft. In such a configuration, since the size of the driven member can be reduced, the increase in the inertia moment can be suppressed more effectively.

The pivot cam mechanism may further include a relative attitude changing unit for changing a relative attitude of the driven member with respect to the pivot member. The relative attitude changing unit may include an eccentric member which is provided eccentrically from a center axis of the first support shaft and is configured to change a phase thereof around a center axis of the first support shaft, and a lever portion which is provided at the driven member and is configured to contact the eccentric member to change a phase of the driven member around a center axis of the second support shaft according to change in the phase of the eccentric member. The relative attitude changing unit may be configured to change the relative attitude of the driven member with respect to the pivot member according to change in the phase of the eccentric member to change the lift characteristics of the valve which occur according to the rotation of the drive cam. In such a configuration, by rotating the first support shaft around its center axis, the phase of the eccentric member is easily changed, and the eccentric member presses the lever portion, thereby changing the relative attitude of the driven member with respect to the pivot member. As used herein, the term "phase" means an angular position of the eccentric member which occurs by the angular displacement of the eccentric member around the center axis of the first support shaft with respect to a predetermined reference position.

The pivot cam mechanism may include a shaft angle displacement means configured to be angularly displaced about the first support shaft around a center axis thereof and a biasing means configured to apply a force to the driven member in a direction to cause the sliding contact surface to contact the drive cam. In such a configuration, since the driven member and the drive cam are always kept in contact with each other, even in the case where the relative attitude of the drive member with respect to the pivot member is changed, it is possible to avoid a noise which would be generated in the configuration in which there is a clearance between the driven member and the drive cam. In addition, the relative attitudes of the drive cam and the driven member can be determined correctly as compared to the configuration in which there is a clearance.

The eccentric member may include a cylindrical roller and is supported by the first support shaft such that the eccentric member is rotatable around a center axis of the roller. In such a configuration, wear of the lever portion of the driven member and the roller which would occur due to sliding friction between them can be reduced.

The pivot member may include two ring-shaped portions which are arranged such that their center axes conform to each other and are rotatably externally fitted to the first support shaft. The eccentric member may be provided to protrude from a peripheral surface of the first support shaft and may be disposed between the two ring-shaped portions. In such a configuration, since the eccentric member can stop displacement of the pivot cam in the center axis direction of the first support shaft, there is no need to provide a stop member exclusively for inhibiting the displacement.

The first support shaft may be provided on a peripheral surface thereof with a recess between the two ring-shaped portions, the eccentric member being disposed in the recess. The lever portion of the driven member may be disposed between the two ring-shaped portions. In such a configuration, the displacement of the eccentric member in the center axis direction of the first support shaft is inhibited, and the eccentric member restricts the ring-shaped portions so as to inhibit the displacement of the pivot member. Further, the ring-shaped portions restrict the lever portion so as to inhibit the displacement of the driven member.

A coil spring may be wound around the first support shaft and may be configured to apply a force to the driven member in a direction to cause the sliding contact surface of the driven member to contact the drive cam. One end of the coil spring is wound around and supported by the second support shaft. In such a configuration, there is no need to provide a member exclusively for stopping the one end of the coil spring with respect to the driven member.

The valve operating system may further comprise a lower support portion configured to support the first support shaft from below; and an upper support portion which is coupled to the lower support portion from above and supports the camshaft from below such that the camshaft is rotatable. An opposite end of the coil spring may be retained in a recess which is formed so as to be sandwiched between the lower support portion and the upper support portion and so as to open outward. In such a configuration, there is no need to provide a member exclusively for stopping the opposite end of the coil spring.

One end and an opposite end of a coil spring may extend from a winding portion forming a coil main body such that the one end and the opposite end extend substantially parallel with each other and toward substantially the same direction. In such a configuration, it is possible to suppress an event that the winding portion of the coil spring contacts the first support shaft with a great force when the pivot cam mechanism is rotated according to the rotation of the drive cam. To be specific, when the pivot cam mechanism operates and the driven member and the pivot member are pivoted, one end portion of the coil spring generates a restoring force for restoring the pivot cam mechanism to its initial attitude, while at the same time, the drag against the restoring force is exerted on the opposite end of the coil spring. For example, when the one end and the opposite end of the coil spring extend in the opposite direction with respect to the winding portion, reactions acting on the winding portion by the forces exerted on the one end and to the opposite end are oriented in the same direction. Because of the reactions, the coil spring is pressed against the first support shaft strongly. On the other hand, when the one end and the opposite end extend from the winding portion substantially parallel with each other and substantially in the same direction as described above, the reactions acting on the winding portion due to the forces exerted on the one end and the opposite end are oriented in substantially opposite directions and cancelled. As a result, it is possible to suppress the event that the coil spring is pressed against the first support shaft strongly.

The engine may have a plurality of ports which are aligned. The pivot cam mechanism may be provided to correspond to each of the ports. The driven members included in at least two adjacent pivot cam mechanisms may be supported by one second support shaft. One end of each of the coil springs may be wound around and supported by both ends of the second support shaft. In such a configuration, since the coil springs provided at both ends of the second support shaft, so as to sandwich at least the two driven members, apply a force to the transmission cam, the coil springs can be reduced in number. By reducing the coil springs in number, the inertia moment of the pivot cam mechanism can be reduced.

In the valve operating system of the present invention, positions and shapes of the drive cam, the driven member, and the pivot member may be designed so that a valve maximum acceleration point at which an acceleration of the valve is a maximum is located in a front part of a valve acceleration period in which the acceleration of the valve has a positive value while the drive cam is rotating once.

In such a configuration, the valve maximum acceleration point is located where the valve starts positive acceleration and is displaced at a low speed (i.e., front part of the valve acceleration period), and the maximum value of the PV value can be reduced. To be specific, the surface pressure P is a value obtained by dividing the contact load between the drive cam and the driven member by the contact surface between them. The contact load is determined by the inertia force of the tappet and the followers (tappet, valve, etc), the inertia force of the pivot cam, a force of a valve spring, etc, and the PV value is at a maximum in the rear part of the valve acceleration period. Accordingly, by locating the valve maximum acceleration point in the front part of the valve acceleration period, the acceleration of the valve in the rear part of the valve acceleration period can be reduced, and the inertia force of the tappet and the followers at the point in time when the PV value is at its peak can be reduced. As a result, the maximum value of the PV value can be reduced. As used herein, the term "valve acceleration period in which the acceleration of the valve has a positive value" means a period during which the surface pressure P generated between the drive cam and the driven member is increasing.

Positions and shapes of the drive cam, the driven member, and the pivot member, may be designed so that an absolute value of an acceleration change rate of the valve per unit angular displacement of the drive cam is larger in the front part which is forward relative to the valve maximum acceleration point of the valve acceleration period than in a rear part which is rearward relative to the valve maximum acceleration point of the valve acceleration period. In such a configuration, since the acceleration of the valve can be reduced in the rear part (i.e., rear part which is rearward relative to the valve maximum acceleration point) of the valve acceleration period during which the valve is displaced at a relatively high speed, the inertia force of the tappet and the follower in this period can be reduced and the thus the maximum value of PV value can be reduced in this period.

In the valve operating system of the present invention, positions and shapes of the drive cam, the driven member, and the pivot member are designed so that a pivot member maximum acceleration point at which an acceleration of the pivot member is at a maximum is located in a front part of a pivot member acceleration period in which the acceleration of the pivot member has a positive value while the drive cam is rotating once.

In such a configuration, the pivot member maximum acceleration point is located where the pivot member starts positive acceleration and is displaced at a low speed (i.e., front part in the pivot member acceleration period). Therefore, the inertia force of the pivot cam which is one factor for determining the contact load between the drive cam and the driven member, can be reduced in the rear part of the period in which the peak of the PV value is located, and thus, the maximum value of the PV value can be reduced. As used herein, the term "pivot member acceleration period in which the acceleration of the pivot member has a positive value" is referred to as a period in which the surface pressure P generated between the drive cam and the driven member is increasing.

Positions and shapes of the drive cam, the driven member, and the pivot member may be designed so that the acceleration of the pivot member is substantially zero at a position of the drive cam where a PV value is at a maximum, the PV value being a multiplication value of a surface pressure and a sliding speed at contact portions of the drive cam and the driven member. In such a configuration, since the acceleration of the pivot member is substantially zero, the influence of the pivot cam inertia at the point in time when the PV value is at a maximum can be lessened, and the maximum value of the PV value can be reduced. As used herein, the phrase "the acceleration of the pivot member is substantially zero" means that the acceleration need not be zero in a strict sense so long as it is sufficiently smaller than the peak value of the acceleration of the pivot cam. For example, the acceleration may be 10% or less of the maximum value of the pivot cam and preferably 5% or less of the maximum value.

An angle formed between a line segment connecting a rotational center axis of the drive cam to a center of angular displacement of the pivot member and a line segment connecting the rotational center axis of the drive cam to a contact point between the drive cam and the driven member may be set to an acute angle. By causing the driven member and the drive cam to contact each other without the roller between them, the contact point can be made closer to the pivot center of the pivot member, and thus the inertia moment of the pivot cam mechanism can be reduced. Since the angle formed between the line segment connecting the rotational center axis of the drive cam to the center of angular displacement of the pivot member and the line segment connecting the rotational center axis of the drive cam to the contact point between the drive cam and the driven member is set to the acute angle, the size of the driven member can be reduced, and the inertia moment of the driven member can be reduced. As a result, the PV value can be reduced.

The set angle may be set in a range between 35 degrees and 45 degrees. As the set angle is made smaller, the distance from the center axis of the first support shaft to the contact point can be made smaller and the driven member can be made shorter. Therefore, the inertia moment of the driven member can be reduced. There is a likelihood that a cam top radius (i.e., distance from the center axis of the drive cam to the cam nose) of the drive cam can be reduced by setting the set angle smaller and thereby, the maximum value of the V value can be reduced. Supposing that the lift characteristics of the valve during one rotation of the drive cam are not changed, the contact portions of the drive cam and the driven member are closer to the center of the angular displacement of the pivot member due to reduction of the size of the driven member according to the reduced set angle, and therefore the PV value tends to be large, because the moment acting on the driven member needs to be invariable. Therefore, to reduce the PV value, the smaller set angle is not better but there is an optimal value of the set angle. The set angle is preferably an acute angle, which is more preferably, in a range between 35 degrees and 45 degrees.

The pivot members included in the pivot cam mechanisms for an intake port and for an exhaust port may have an identical shape and the driven members included in the pivot cam mechanisms for the intake port and for the exhaust port may have an identical shape. In such a configuration, since the pivot cam mechanisms provided in the respective ports can be formed to have an identical structure, a manufacturing cost can be reduced.

An engine of the present invention comprises the aforesaid valve operating system, a cylinder head and a cylinder head cover which are arranged in an axial direction of a cylinder, the cylinder head cover being removably attached to the cylinder head; wherein the cylinder head cover is moved in a direction perpendicular to the axial direction to removably attach the cylinder head cover to the cylinder head.

In such a configuration, by moving the cylinder head cover with respect to the cylinder head in one direction in the direction perpendicular to the axial direction, the cylinder head cover can be removed from the cylinder head. Therefore, when removing the cylinder head cover, it is not necessary to move the cylinder head cover upward a great amount with respect to the cylinder head. For this reason, even in a vehicle in which there is a small gap (e.g., gap between the cylinder head cover and the main frame) above the cylinder head cover, the cylinder head cover can be removed without unloading the engine from the vehicle.

To attach the cylinder head cover, the cylinder head cover is moved in the opposite direction in the direction perpendicular to the axial direction as in the case of removing the cylinder head cover. For this reason, even in a vehicle in which there is a small gap above the cylinder head cover, the cylinder head cover can be attached without unloading the engine from the vehicle. This can reduce the number of work steps during maintenance of the engine, and can improve operation efficiency.

In the above invention, the cylinder head cover may be dividable into one part and the other part in the direction perpendicular to the axial direction. In such a configuration, one of the parts into which the cylinder head cover is divided in the direction perpendicular to the axial direction can be moved in one direction in the direction perpendicular to the axial direction or the other can be moved in the opposite direction, even in the structure in which built-in components or members protrude into the cylinder head cover. As a result, the cylinder head cover can be moved in the direction perpendicular to the axial direction, without interference between the built-in components or members and the wall portion of the cylinder head cover which is formed to extend in the direction perpendicular to the axial direction.

The above and further objects and features of the invention will more fully be apparent from the following detailed description with accompanying drawings.

DETAILED DESCRIPTION OF THE EMBODIMENTS

Hereinafter, a valve operating system of the present invention will be described with reference to the drawings. By way of example, a motorcycle in which an engine including the valve operating system is mounted will be described with reference to the drawings.

[Motorcyle]

Figure 1:
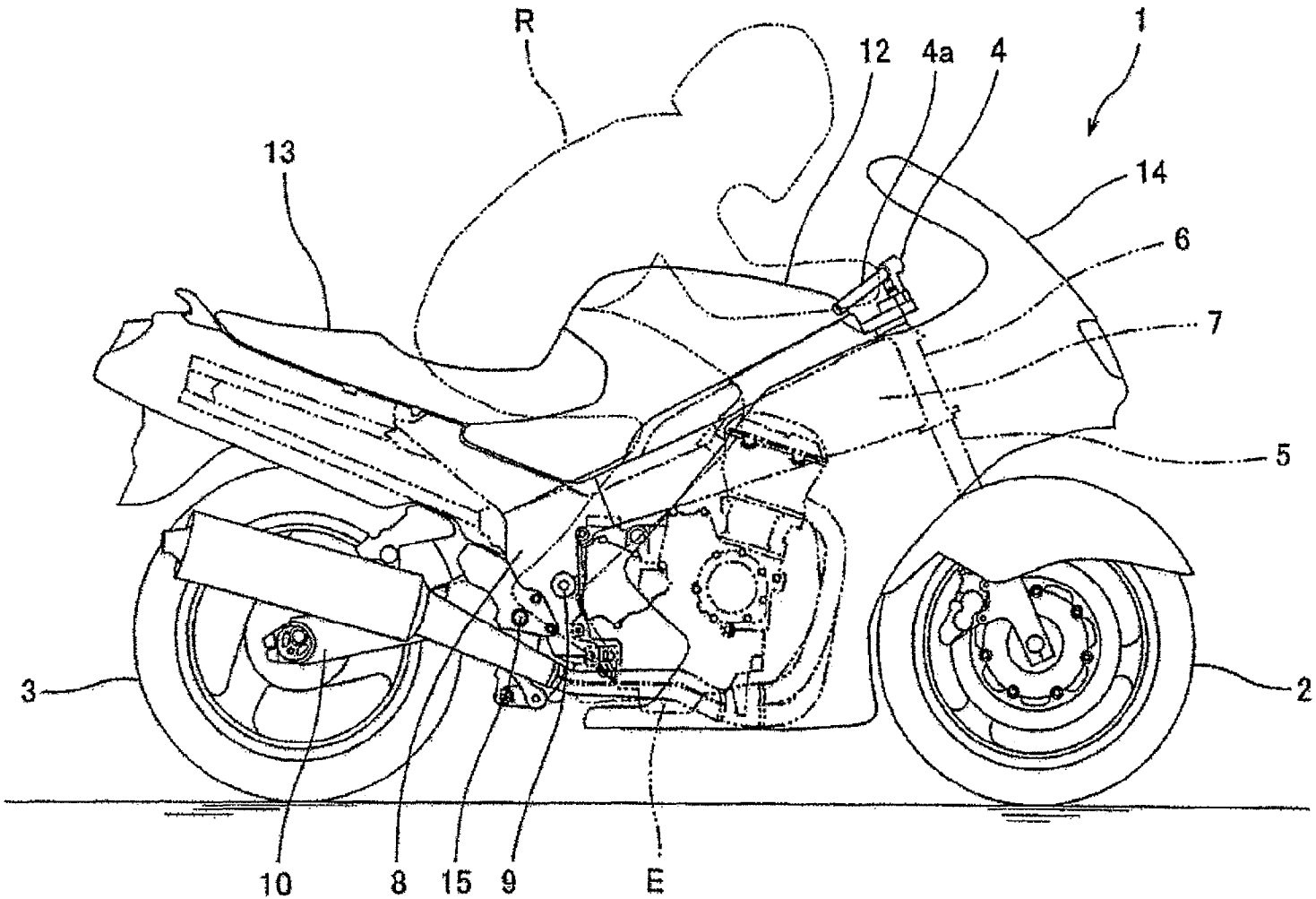
FIG. 1 is a right side view of a motorcycle 1 equipped with an engine E including a valve operating system according to an embodiment of the present invention.

FIG. 1 is a right side view of a motorcycle 1 equipped with an engine E including the valve operating system according to this embodiment of the present invention. As used herein, the direction used in Embodiments described below is such that a driving direction of the motorcycle 1 is forward and the other directions are referenced from a rider R mounting a motorcycle 1.

As shown in FIG. 1, the motorcycle 1 includes a front wheel 2 and a rear wheel 3. The front wheel 2 is rotatably mounted to a lower portion of a front fork 5 extending substantially vertically. The front fork 5 is mounted to a steering shaft (not shown) by an upper bracket (not shown) provided at an upper end portion thereof and an under bracket provided under the upper bracket. The steering shaft is rotatably mounted by a head pipe 6. A bar-type steering handle 4 extending rightward and leftward is mounted to the upper bracket. By the rider R's operation for rotating the steering handle 4, the front wheel 2 can be rotated in a desired direction around the steering shaft.

A pair of right and left main frame members 7 forming a vehicle body frame extend rearward from the head pipe 6. A pivot frame member (also referred to as a swing arm bracket) 8 extends downward from a rear portion of each of the main frame members 7. A swing arm 10 extending in a forward and rearward direction is mounted at a front end portion thereof to a pivot 9 provided at the pivot frame member 8. The rear wheel 3 is rotatably mounted to a rear end portion of the swing arm 10.

A fuel tank 12 is disposed above the main frame members 7 and behind the steering handle 4. A straddle-type seat 13 is disposed behind the fuel tank 12. An engine E is mounted below and between the right and left main frame members 7. A driving power of the engine E is transmitted to the rear wheel 3 via a chain (not shown). The rear wheel 3 rotates, enabling a propulsive force to be generated in the motorcycle 1. A cowling 14 is provided integrally so as to cover a front part of the motorcycle 1, to be precise, the head pipe 6, front portions of the main frame members 7, and side portions of the engine E. In the motorcycle 1 having such a construction, mounting the seat 13, the rider R rides the motorcycle 1. Gripping grips 4*a* provided at end portions of the steering handle 4, and putting feet on steps 15 provided in the vicinity of the rear portion of the engine E, the rider R drives the motorcycle 1.

[Engine]

Figure 2:
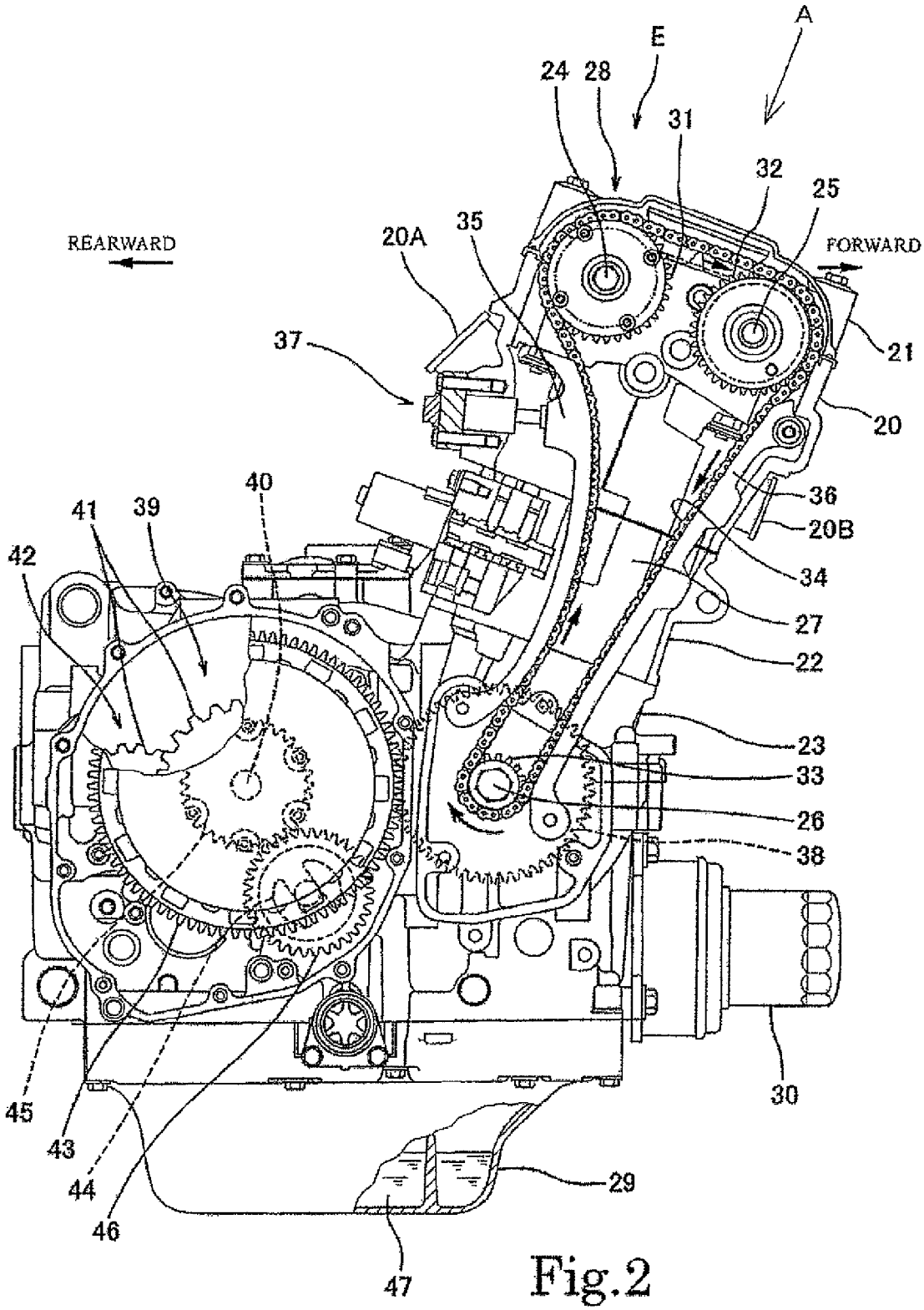
FIG. 2 is a right side view of the engine of FIG. 1, a part of which is illustrated in cross-section.

FIG. 2 is a right side view of the engine of FIG. 1, a part of which is illustrated in cross-section. As shown in FIG. 2, the engine E includes as major components, a cylinder head 20, a cylinder head cover 21, a cylinder block 22, and a crankcase 23. The engine E is an inline four-cylinder double overhead camshaft (DOHC) engine in which cylinders are arranged in a vehicle width direction.

An intake port 20A is provided on the rear portion of the cylinder head 20 to correspond to each cylinder and to open obliquely rearward and upward. An exhaust port 20B is provided on the front portion of the cylinder head 20 to correspond to each cylinder and to open forward. In the engine E of this embodiment, two intake ports 20A and two exhaust ports 20B are provided for each cylinder.

A drive camshaft 24 for an air-intake system and a drive camshaft 25 for air-exhaust system are arranged in an upper portion of the cylinder head 20 such that their axes extend in the vehicle width direction. The drive camshafts 24 and 25 are rotatably retained by shaft support brackets 49 (see FIG. 3) including lower brackets 81 and upper brackets 82 as described later. The cylinder head cover 21 is provided over the shaft support brackets 49 and is fastened to the cylinder head 20 by bolts.

Cylinder blocks 22 respectively accommodating pistons (not shown) are respectively coupled to the lower portion of the cylinder head 20. The crankcase 23 accommodating a crankshaft 26 extending such that its axis extends in the vehicle width direction is coupled to the lower portions of the cylinder blocks 22. In a right wall portion of the cylinder head 20, the cylinder head cover 21, the cylinder block 22, and the crankcase 23, a chain tunnel 27 is formed continuously, in which a driving power transmission mechanism 28 for transmitting a rotational driving power of the crankshaft 26 to the drive camshafts 24 and 25 is accommodated. An oil pan 29 for reserving oil for lubrication or hydraulically-powered devices is provided at the lower portion of the crankcase 23. An oil filter 30 for filtering the oil suctioned up by the oil pan 29 is provided at the front portion of the crankcase 23.

The driving power transmission mechanism 28 includes an intake cam sprocket 31, an exhaust cam sprocket 32, a crank sprocket 33, and a timing chain 34. To be specific, the right end portion of the drive camshaft 24 for an air-intake system protrudes into the chain tunnel 27, and the intake cam sprocket 31 is provided at the end portion. In addition, the right end portion of the drive camshaft 25 for the air-exhaust system protrudes into the chain tunnel 27, and the exhaust cam sprocket 32 is provided at the end portion. Furthermore, the right end portion of the crankshaft 26 protrudes into the chain tunnel 27, and the crank sprocket 33 is provided at the end portion.

The timing chain 34 is installed around the intake cam sprocket 31, the exhaust cam sprocket 32, and the crank sprocket 33. When the crank sprocket 33 rotates, the intake cam sprocket 31 and the exhaust cam sprocket 32 rotate in association with the rotation of the crank sprocket 33. Therefore, through the rotation transmission mechanism 28 formed by the intake cam sprocket 31, the exhaust cam sprocket 32, the crank sprocket 33 and the timing chain 34, the rotational driving power of the crankshaft 26 is transmitted to the drive camshafts 24 and 25.

Inside the chain tunnel 27, a movable chain guide 35 and a fixed chain guide 36 are provided. The fixed chain guide 36 extends vertically in front of the timing chain 34 and from a location in front of and in the vicinity of the crank sprocket 33 to a location below and in the vicinity of the exhaust cam sprocket 32. The fixed chain guide 36 is configured to contact the timing chain 34 from front to support the timing chain 34 from front.

The movable chain guide 35 extends vertically behind the timing chain 34. The movable chain guide 35 is mounted at a lower end portion thereof to the right wall portion of the crankcase 23 at a location above and in the vicinity of the crank sprocket 33. An upper end portion of the movable chain guide 35 is located below and in the vicinity of the intake cam sprocket 31. A hydraulically-powered tensioner 37 mounted to the rear wall portion of the cylinder head 20 causes the movable chain guide 35 to apply a force from behind to the timing chain 34 to make the timing chain 34 have a suitable tension.

An output gear 38 configured to output the rotation of the crankshaft 26 is mounted on the right portion of the crankshaft 26 such that the output gear 38 is rotatable integrally with the crankshaft 26. A transmission chamber 39 is formed in the rear portion of the crankcase 23, and accommodates therein an input shaft 40 and an output shaft (not shown) such that the input shaft 40 and the output shaft extend substantially in parallel with the crankshaft 26. A plurality of gears 41 are mounted on the input shaft 40 and the output shaft, constituting a transmission 4.

An input gear 43 is mounted on the right end portion of the input shaft 40 such that the input gear 43 is configured to mesh with the output gear 38 of the crankshaft 26 and is rotatable integrally with the input shaft 40. Therefore, the driving power of the engine E is transmitted from the crankshaft 26 to the input shaft 40 via the output gear 38 and the input gear 43, and its rotational speed is changed by the transmission 42. The resulting driving power is output to the rear wheel 3 (FIG. 1).

The engine E of this embodiment includes a trochoidal rotor type oil pump 44. A driven gear 46 is mounted on an input shaft of the oil pump 44 and is configured to mesh with a drive gear 45 mounted on the input shaft 40 of the transmission 42. According to the rotation of the crankshaft 26, the oil pump 44 is driven. The engine E is provided with oil passages through which oil for lubrication or hydraulic powering flows to deliver oil 47 suctioned up by the oil pump 44 from the oil pan 29 to engine components.

The engine E includes a valve operating system 50A configured to open and close the intake port 20A and a valve operating system 50B configured to open and close the exhaust port 20B, in association with the rotation of the crankshaft 26. The valve operating system 50A is configured to control a flow rate and a timing of air-intake from the intake port 20A to the combustion chamber 52, while the valve operating system 50B is configured to control a flow rate and a timing of air-exhaust from the combustion chamber 52 to the exhaust port 20B. Hereinafter, the valve operating system 50A or 50B will be described in detail.

[Valve Operating System]

Figure 3:
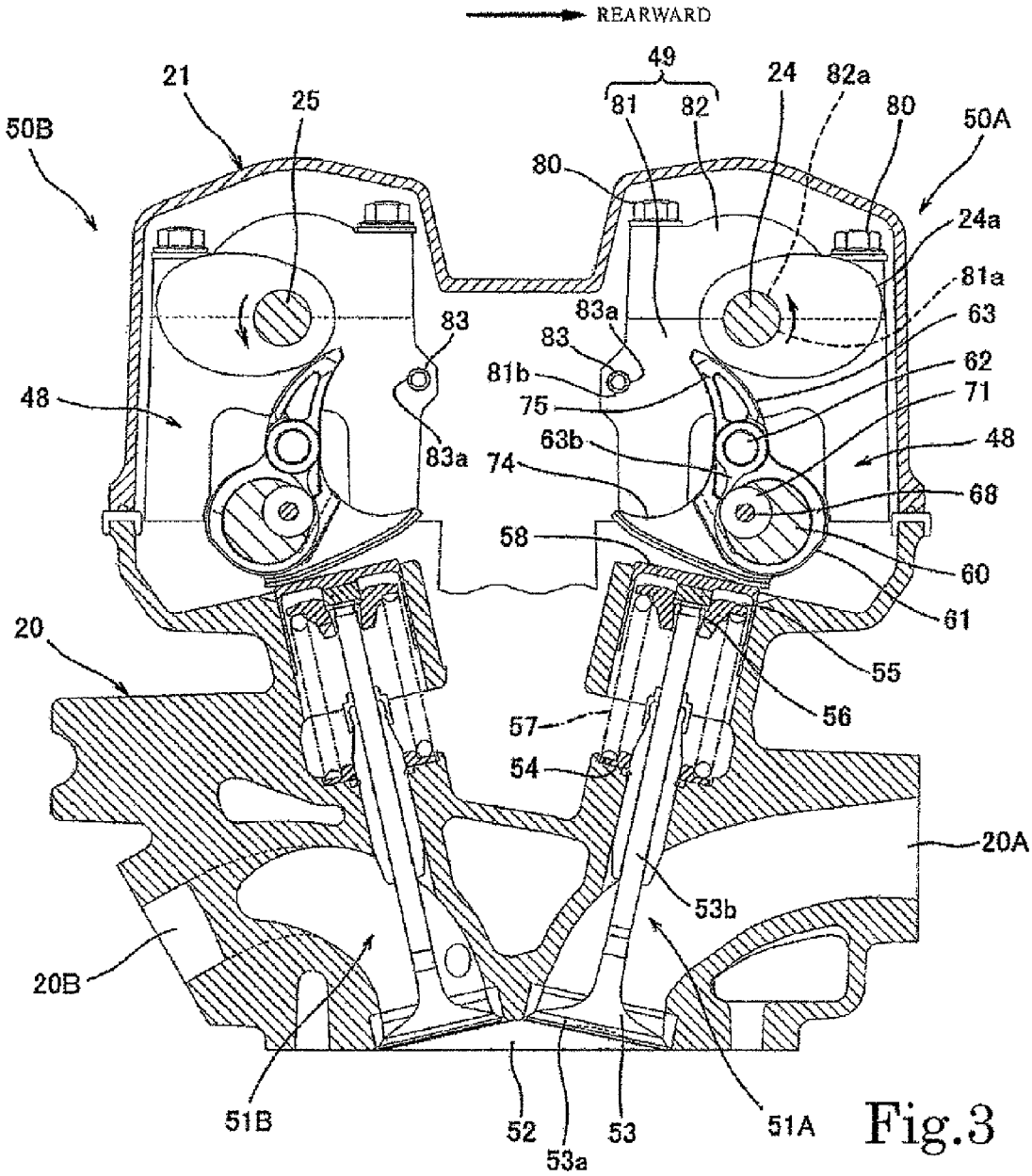
FIG. 3 is an enlarged cross-sectional view of an upper part of the engine of FIG. 2, showing valve operating systems as being enlarged.

FIG. 3 is an enlarged cross-sectional view of an upper part of the engine E of FIG. 2, showing the valve operating systems 50A and 50B, and others, as being enlarged. As shown in FIG. 3, in the cylinder head 20, there are provided an intake valve mechanism 51A configured to open and close the combustion chamber 52 with respect to the intake port 20A and an exhaust valve mechanism 51B configured to open and close the combustion chamber 52 with respect to the exhaust port 20B. In the engine E which is an inline four-cylinder, four combustion chambers 52 respectively corresponding to the cylinders are arranged in one line in the depth direction of the drawing sheet. The intake-side valve operating system 50A causes the intake valve mechanism 51A to perform an opening and closing operation (reciprocating operation), while the exhaust-side valve operating system 50B causes the exhaust valve mechanism 51B to perform an opening and closing operation (reciprocating operation). Since the intake valve mechanism 51A and the exhaust valve mechanism 51B have substantially the same structure and the valve operating system 50A and the valve operating system 50B have substantially the same structure in the air-intake system and in the air-exhaust system, the valve mechanism 51A and the valve operating system 50A in the air-intake system will be described hereinafter.

The intake valve mechanism 51A has a known structure. The intake valve mechanism 51A includes a valve body 53 including a valve plug 53*a* facing the combustion chamber 52 in the intake port 20A and a stem 53*b* extending upward from the valve plug 53*a*. A groove is formed at an upper end portion of the stem 53*b*. A cotter 56 is inserted into the groove. A spring retainer 55 is mounted to the cotter 56. A spring seat 54 is mounted to the cylinder head 20 below the spring retainer 55. A valve spring 57 is mounted between the spring seat 54 and the spring retainer 55. The valve spring 57 applies an upward force to the valve body 53 with the spring retainer 55 interposed therebetween, i.e., to close the intake port 20A.

The valve operating system 50A includes the drive camshaft 24 configured to operate in association with the rotation of the crankshaft 26 of the engine E, a drive cam 24*a* fixed to the drive camshaft 24, and a pivot cam mechanism 48 which is configured to contact the drive cam 24*a* and to transmit the movement of the drive cam 24*a* to a tappet 58 of the intake valve mechanism 51A.

The pivot cam mechanism 48 is configured to transmit the driving power exerted by the drive cam 24*a* to the intake valve mechanism 51A. Thereby, the intake valve mechanism 51A obtains the driving power for opening and closing the intake port 20A according to the rotation of the crankshaft 26. The entire outer shape of the pivot cam mechanism 48 is changed by a motor 87 in this embodiment, which is an example of a drive means forming a shaft angle displacement means for angularly displacing a control shaft 60 described later around its center axis 60*a*. Thereby, the timing at which the driving power is transmitted from the drive cam 24*a* to the intake valve mechanism 51A or a displacement amount of the intake valve mechanism 51A is changed. Therefore, the opening and closing timings and opening and closing amounts of the intake port 20A which are operative in association with the rotation of the crankshaft 26, i.e., the lift characteristics of the intake valve mechanism 51A can be changed as desired.

The drive cam 24*a* has a non-circular contour as viewed along the rotational center thereof. The drive cam 24*a* has a shape in which a distance between a location on the contour and the rotation center of the drive cam 24*a* changes along the counter.

[Pivot Cam Mechanism]

Figure 4:
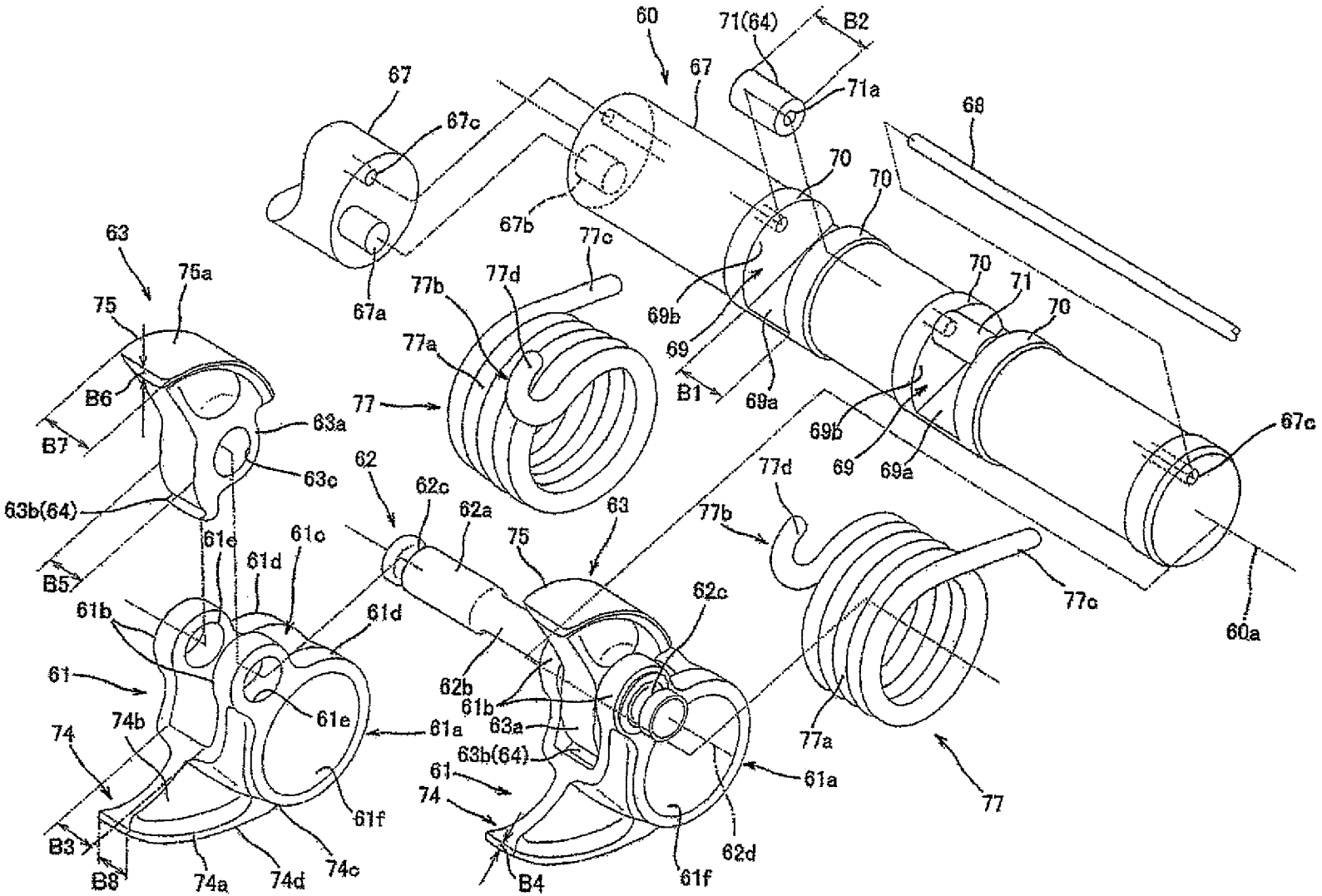
FIG. 4 is an exploded perspective view of a pivot cam mechanism of FIG. 3.
Figure 5:
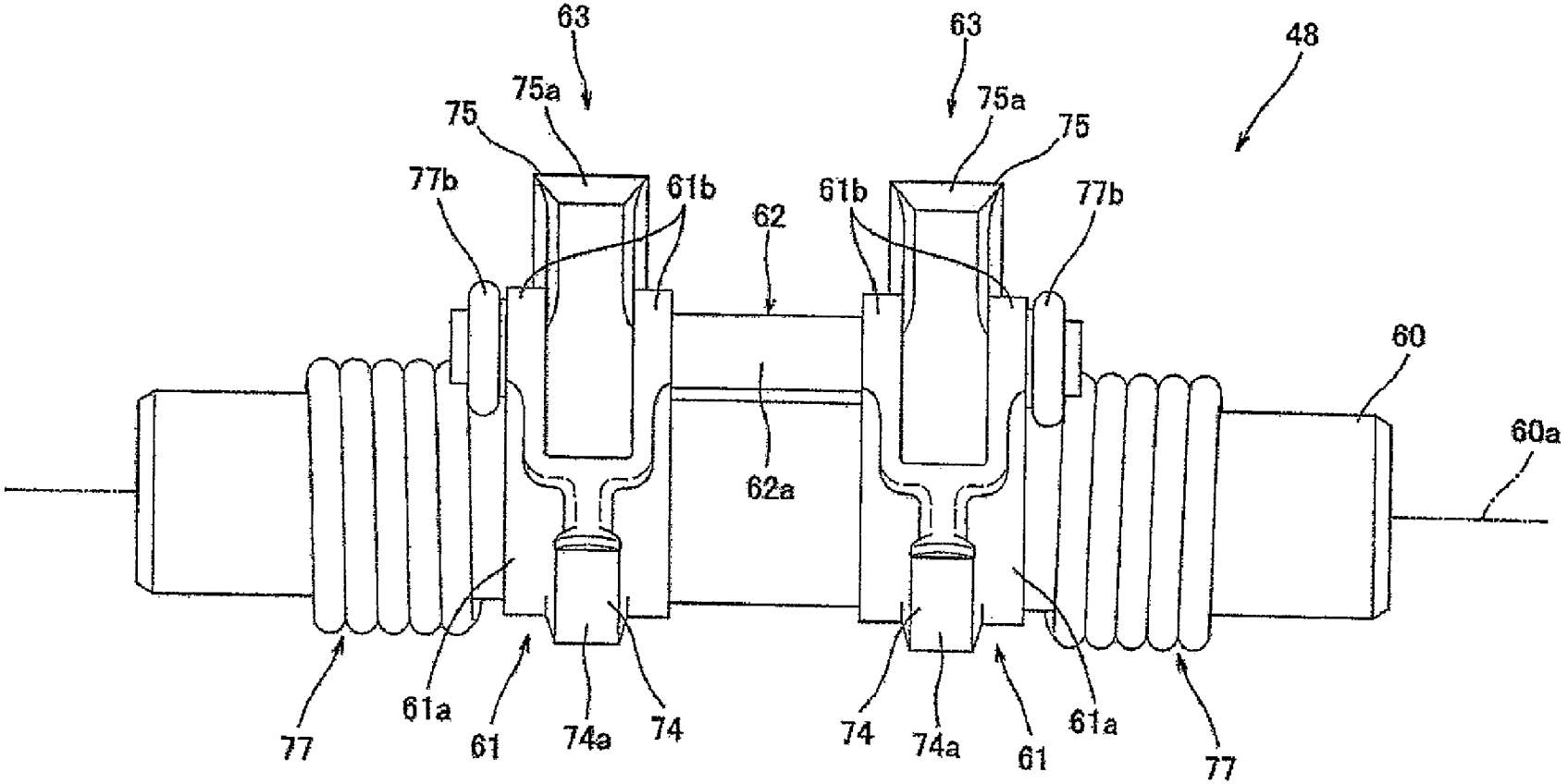
FIG. 5 is a front view of a major part of an assembled pivot cam mechanism.
Figure 6:
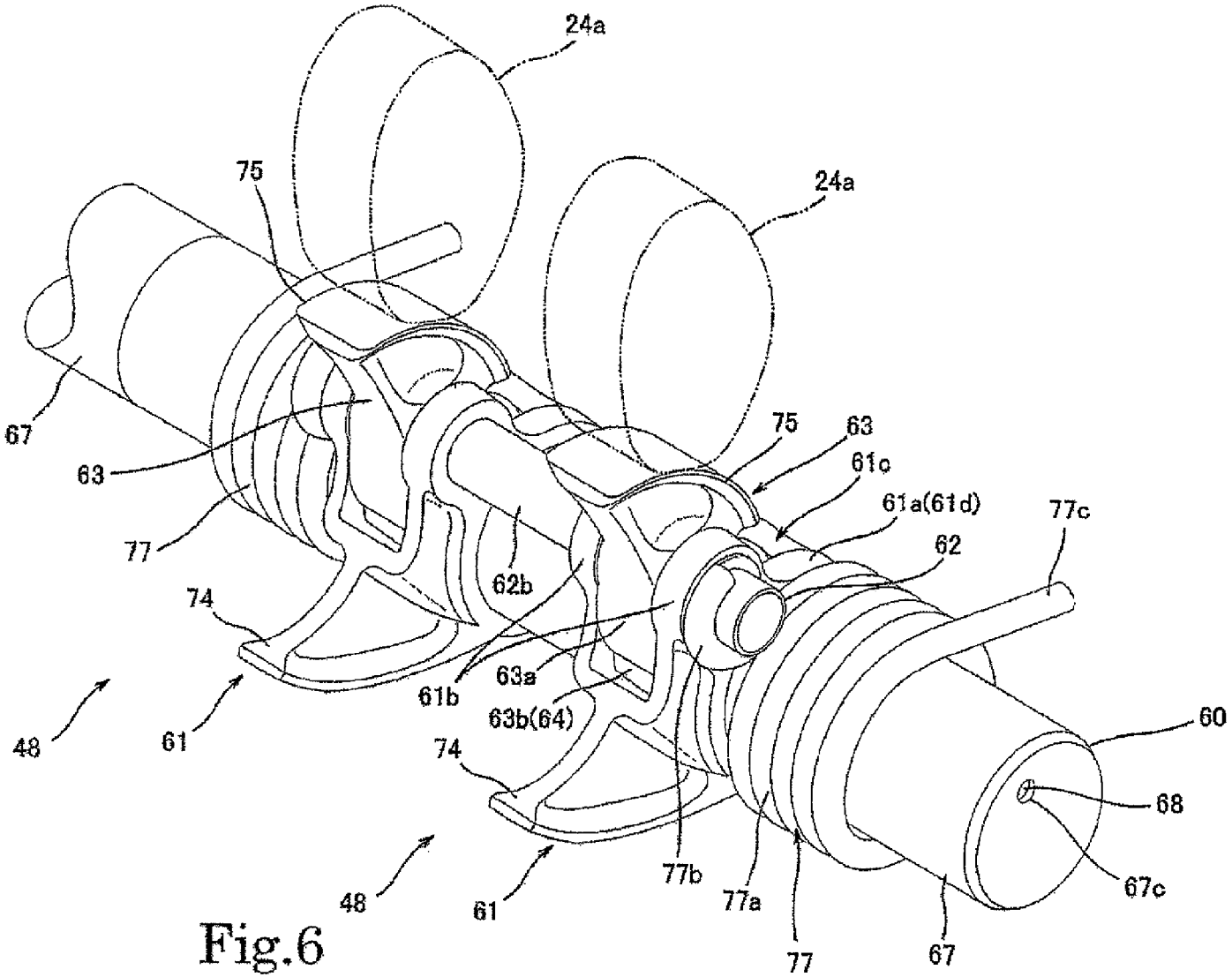
FIG. 6 is a perspective view of a major part of the pivot cam mechanism of FIG. 5.
Figure 7:
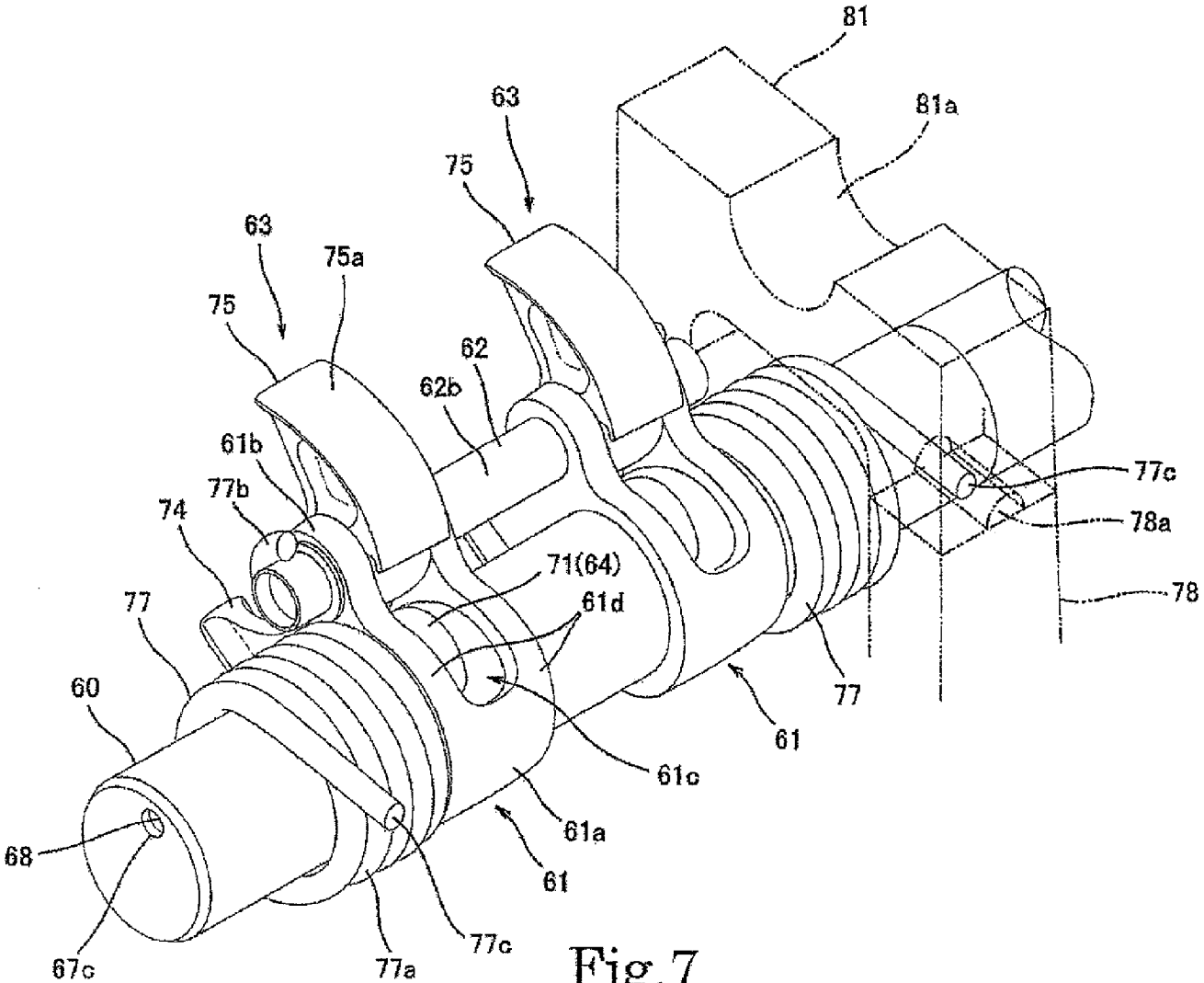
FIG. 7 is a perspective view of a major part of the pivot cam mechanism of FIG. 5 as viewed from another angle.

FIG. 4 is an exploded perspective view of the pivot cam mechanism 48 of FIG. 3. FIG. 5 is a front view of a major part of an assembled pivot cam mechanism 48. FIG. 6 is a perspective view of a major part of the pivot cam mechanism 48 of FIG. 5. FIG. 7 is a perspective view of a major part of the pivot cam mechanism 48 of FIG. 5 as viewed from another angle. The valve operating system 50A of this embodiment includes two pivot cam mechanisms 48 respectively corresponding to two intake valve mechanisms 51A configured to open and close two intake ports 20A provided for each cylinder.

The valve operating system 50A includes as major components a control shaft 60 which is an example of a first support shaft, two pivot members 61 which are angularly displaceably supported by the control shaft 60 and are configured to respectively press the tappets 58, two driven members 63 which are angularly displaceably supported by a coupling pin 62 which is an example of a second support shaft supported by the pivot cams 61 and are configured to contact the drive cams 24*a*, and two relative attitude changing mechanisms 64 configured to change relative attitude of the driven members 63 relative to the pivot members 61. In this embodiment, the valve operating system 50A includes two pivot cam mechanisms 48 each including one pivot member 61, one driven member 63, and one relative attitude changing mechanism 64.

In the pivot cam mechanism 48, the driven member 63 and the pivot member 61 are angularly displaced so as to be pivoted around a center axis 60*a* of the control shaft 60 to apply the driving power exerted by the drive cam 24*a* to the intake valve mechanism 51A, opening and closing the intake port 20A. The relative attitude changing mechanism 64 causes the driven member 63 to be angularly displaced around a center axis 62*d* of the coupling pin 62, changing the relative attitude of the driven member 63 with respect to the pivot member 61. By changing the relative attitude, the timing at which the driving power is transmitted from the drive cam 24*a* to the intake valve mechanism 51A or the displacement amount of the intake valve mechanism 51A are changed so that the lift characteristics of the intake valve mechanism 51A are changed.

As shown in FIG. 4, the control shaft 60 has a substantially cylindrical shape. In this embodiment, a plurality of sub-shafts 67 are coupled to form the control shaft 60. A fitting protrusion 67*a* protrudes from an end portion of one sub-shaft 67 of the sub-shafts 67 coupled to each other at a location deviated from the center axis of the sub-shaft 67, while a fitting hole 67*b* conforming in shape to the fitting protrusion 67*a* is formed at an end portion of the other sub-shaft 67. Each sub-shaft 67 has a circular insertion hole 67*c* formed to penetrate along the center axis in a location deviated from the center axis.

The sub-shafts 67 are coupled coaxially to form the control shaft 60 in such a manner that the end portions thereof are opposite to each other, the fitting protrusion 67*a* of one of the sub-shafts 67 is fitted into the fitting hole 67*b* of the other sub-shaft 67, and a round-rod-like roller shaft 68 having a dimension which is a sum of the sub-shafts 67 is inserted into the insertion holes 67*c*. Since the control shaft 60 is formed by the plural sub-shafts 67 in this manner, the insertion holes 67*c* provided in the respective sub-shafts 67 can be formed accurately.

Shaft cut portions 69 are respectively formed at plural specified locations in the longitudinal direction of the control shaft 60. The shaft cut portions 69 form recesses which are recessed radially toward the center relative to the remaining portion. In this embodiment, the shaft cut portion 69 has a predetermined width B1 and has a substantially semi-circular shape in cross-section which is perpendicular to the center axis 60*a*. More specifically, the shaft cut portion 69 has a shape including a bottom wall surface 69*a* of a rectangular flat surface shape and side wall surfaces 69*b* of a substantially semi-circular shape which extend upward from both side portions of the bottom wall surface 69*a*. The insertion hole 67*c* is formed to penetrate the side wall surfaces 69*b* of the cut portion 69 near a location distant from the bottom wall surface 69*a*. In the control shaft 60, peripheral portions 70 adjacent at right and left sides of the cut portion 69 have a larger outer dimension than the other portion.

A roller 71 which is supported by a roller shaft 68 is attached to the control shaft 60 as an eccentric member provided in a location eccentric from the center axis 60*a*. In this embodiment, the roller 71 has a cylindrical shape, and is formed such that a dimension B2 in the center axis direction thereof is substantially equal to the width B1 of the shaft cut portion 69 (to be precise, the dimension B2 in the center axis direction of the roller 71 is slightly smaller than the width B1 of the shaft cut portion 69). An insertion hole 71*a* is formed in the center axis position of the roller 71 so as to have an inner diameter which is substantially equal to that of the insertion hole 67*c* of the control shaft 60. The roller 71 is mounted in the control shaft 60 such that the roller shaft 68 is inserted into the insertion hole 71*a* of the roller 71 when the roller shaft 68 is inserted into the insertion hole 67*c* of the control shaft 60. The roller 71 is supported by the roller shaft 68 such that the roller 71 is rotatable around the center axis of the roller shaft 68. The roller 71 mounted in the manner described above is disposed with a slight gap with the right and left side surfaces 69*b* of shaft cut portion 69 and eccentrically from the center axis of the control shaft 60. The center axis of the roller 71 is located inside the cross-section of the control shaft 60. In this embodiment, the roller 71 partially protrudes outward from the outer peripheral surface of the control shaft 60.

Two pivot cams 61 which are constituents of the valve operating system 50A are externally fitted to the control shaft 60. Each pivot cam 61 is supported by the control shaft 60 such that the pivot cam 61 is angularly displaceable around the center axis 60*a* of the control shaft 60. The pivot cam 61 includes an outer fitting tubular portion 61*a* which is externally fitted to the control shaft 60 and is rotatably supported around the center axis 60*a* of the control shaft 60, a bearing portion 61*b* protruding from the outer peripheral portion of the outer fitting tubular portion 61*a*, and a tappet pressing portion 74 which extends outward from the outer fitting tubular portion 61*a* and is configured to press the tappet 58.

The outer fitting tubular portion 61*a* forms a cylindrical shape and is provided with a circular through-hole 61*f* into which the control shaft 60 is inserted. A tubular cut portion 61*c* which is cut in a circumferential direction is formed in an intermediate axial portion of the outer fitting portion 61*a*. As a result, ring-shaped portions 61*d* are provided at the outer fitting tubular portion 61*a* such that the ring-shaped portions 61*d* are spaced apart in the center axis direction with the tubular cut portion 61*c* interposed between them. In this embodiment, the width of the tubular cut portion 61*c* of the outer fitting tubular portion 61*a*, i.e., a distance B3 in the center axis direction between the ring-shaped portions 61*d* is substantially identical to the width B1 of the shaft cut portion 69.

The bearing portions 61*b* respectively protrude radially outward from the ring-shaped portions 61*d* and are respectively provided with through-holes 61*e* extending in the center axis direction, into which the coupling pin 62 is inserted.

The tappet pressing portion 74 extending from the outer fitting portion 61*a* includes a pressing wall portion 74*a* which has a predetermined thickness B4 in the direction in which the tappet pressing portion 74 is applied with a force from the tappet 58 and is configured to contact the tappet 58, and a rib 74*b* coupling the pressing wall portion 74*a* to the outer fitting tubular portion 61*a*. The outer wall surface of the pressing wall portion 74*a* includes a base circular-arc surface 74*c* whose center coincides with the center axis of the ring-shaped portion 61*d*, and a lift curved surface 74*d* which extends continuously from the base circular-arc surface 74*c* and changes a distance between the center axis of the ring-shaped portion 61*d* and the outer peripheral surface thereof changes, for example, increases in the direction closer to the tip end. The rib 74*b* extends from the pressing wall portion 74*a*, is branched at an intermediate point in one direction and in an opposite direction in the center axis direction, and the branched portions are coupled to the ring-shaped portions 61*a* and the bearing portions 61*b*.

The driven member 63 is supported by the pivot member 61 via the coupling pin 62 having a hollow pipe shape with a smaller diameter than the control shaft 60. The driven member 63 includes an insertion portion 63*a* into which the coupling pin 62 is inserted, a lever portion 63*b* extending radially in one direction from the insertion portion 63*a*, and a drive cam contact portion 75 which extends radially in an opposite direction from the insertion portion 63*a* and is configured to contact the drive cam 24*a*. The insertion portion 63*a* has a width B5 which is substantially equal to a distance B3 between the right and left bearing portions 61*b* of the pivot cam 61 (to be precise, width B5 which is slightly smaller than the distance B3 of the bearing portion 61*b*), and has a through-hole 63*c* into which the coupling pin 62 is inserted. The outer peripheral surface of the drive cam contact portion 75 forms a circular-arc sliding contact surface 75*a* which has a center set in a position different from the center axis, for example, and changes a distance between the outer peripheral surface thereof and the center axis of the insertion portion 63*a* in a direction toward the tip end. The outer peripheral surface of the drive cam contact portion 75 is a surface subjected to a surface hardening treatment such as chromium plating. In this embodiment, the circular-arc sliding contact surface 75*a* is harder than the lift curved surface 74*d* of the pressing wall portion 74*a*. The drive cam contact portion 75 of the driven member 63 which contacts the drive cam 24*a* has a predetermined thickness B6 in a direction in which the drive cam contact portion 75 is applied with a force from the drive cam 24*a*. The thickness B6 is larger than the thickness B4 of the pressing wall portion 74*a* of the pivot cam 61 which contacts the tappet 58 so that the drive cam contact portion 75 has high wear resistance to the contact with the drive cam 24*a* rotating at a high speed. In addition, a center axis dimension B7 of the drive cam contact portion 75 is set larger than a center axis dimension B8 of the pressing wall portion 74*a*.

By inserting the coupling pin 62 into the through-holes 61*e* and 63*c* of the bearing portion 61*b* and the insertion portion 63*a* in a state where the insertion portion 63*a* of the driven member 63 is located between the right and left bearing portions 61*b* of the pivot member 61, the through-holes 61*e* of the bearing portions 61*b* and the through-hole 63*c* of the insertion portion 63*a* are coaxial with each other. Thus, the driven member 63 is rotatably supported with respect to the coupling pin 62. The coupling pin 62 is configured to support the two driven members 63 in the vicinity of the both end portions thereof. The coupling pin 62 has a structure in which a portion of the coupling pin 62 between the right and left driven members 63 (i.e., portion between right and left support portions 62*a*) has a smaller outer dimension than the right and left support portions 62*a* to which the bearing portions 61*b* and the insertion portion 63*a* are externally fitted and support the driven members 63. Thus, a lightweight the coupling pin 62 is achieved.

Coil springs 77 which are an example of a biasing means are externally fitted to the control shaft 60. One end of each coil spring 77 is supported at an end portion of the coupling pin 62. In more detail, the coil spring 77 is formed by winding a metal-made round-rod member having a predetermined elasticity plural times. The inner diameter of a winding portion 77*a* forming a coil main body winding is slightly larger than the outer diameter of the control shaft 60. One end 77*b* and an opposite end 77*b* of the coil spring 77 extend in opposite directions along a tangential direction of the outer peripheral surface of the winding portion 77*a*. The one end 77*b* has a stop winding portion 77*d* which is wound in the direction opposite to the direction in which the winding portion 77*a* is wound and has a smaller diameter than the winding portion 77*a*.

As an example of a stop portion, a stop groove portion 62*c* forming a recess extending in the circumferential direction and having a substantially semi-circular cross-section is provided at an end portion of the coupling pin 62 supporting the one end 77*b* of the coil spring 77. The stop winding portion 77*d* is fitted into the stop groove portion 62*c*, so that the one end 77*b* of the coil spring 77 is stopped by the coupling pin 62. The opposite end 77*c* of the coil spring 77 is inserted into and retained in a recess 78*a* which is formed between the lower surface of the lower bracket 81 (see FIG. 3) supporting the drive camshaft 24 from below and the upper surface of a mounting portion 78 which is provided at the upper portion of the cylinder head 20, supports the control shaft 60 from below, and is attached with the lower bracket 81 from above (see FIG. 21(*a*)). That is, in this embodiment, by the mounting portion 78 which is an example of the lower support portion supporting the control shaft 60 from below and the lower bracket 81 supporting the drive cam 24 from below and attached to the mounting portion 78 from above, the opposite end 77*c* of the coil spring 77 is retained from above and from below. A recessed region is formed on the lower surface of the lower bracket 81 to open upward. The recess 78*a* is formed so as to open outward (toward the control shaft 60 in FIG. 7) and so as to be sandwiched between the mounting portion 78 and the lower bracket 81 which is attached to the mounting portion 78 from above. The opposite end 77*c* of the coil spring 77 is inserted into and retained in the recess 78*a* (se FIG. 7).

As described above, the pivot cam mechanism 48 according to this embodiment is mainly comprised of relatively few constituents which are the control shaft 60, the pivot member 61, the driven member 63, and the coil spring 77. The pivot cam mechanism 48 is assembled in a procedure described below. First, the control shaft 60 is inserted into the ring-shaped portions 61*a* of each pivot member 61 and is disposed such that the tubular cut portion 61*c* of the pivot member 61 and the shaft cut portion 69 of the control shaft 60 conform to each other. In this state, the roller 71 is fitted to the shaft cut portion 69 of the control shaft 60 through the tubular cut portion 61*c* of the pivot member 61, and the roller shaft 68 is inserted into the insertion hole 67*c* of the control shaft 60. And, the roller shaft 68 is also inserted into the insertion hole 71*a* of the roller 71 to allow the roller 71 to be supported by the control shaft 60.

At this time, the roller 71 protrudes from the outer peripheral surface of the control shaft 60 and is fixed. Therefore, the pivot member 61 with the roller 71 located between the right and left ring-shaped portions 61*a* is restricted in displacement in the rightward and leftward direction, but is angularly displaceable in a predetermined angle range around the center axis of the control shaft 60.

Then, the driven member 63 is disposed between the right and left bearings 61*b* of the pivot member 61 such that the through-holes 61*e* and 63*c* conform to each other. The coupling pin 62 is inserted into the through-holes 61*e* and 63*c*. Then, the coil springs 77 are externally fitted to the control shaft 60 from both sides of two sets of pivot members 61 and driven members 63. The stop winding portion 77*d* at the one end 77*b* is wound around and stopped by the stop groove 62*c* at the end portion of the coupling pin 62. The opposite end 77*c* is located in the recess 78*a* formed between the mounting portion 78 of the cylinder head 20 and the lower bracket 81 when the lower brackets 81 are attached to the cylinder head 20. Thereby, the driven member 63 is subjected to a force applied from the coil spring 77 in the direction to cause the circular-arc sliding contact surface 75*a* to contact the drive cam 24*a*. Thus, two pivot cam mechanisms 48 are assembled as shown in FIGS. 6 and 7.

The pivot cam mechanism 48 having the above described structure is like a locker arm which is provided between the drive cam 24*a* and the intake valve mechanism 51A. To be specific, the locker arm which forms an elongated arm and is pivoted at an intermediate portion thereof is divided at a position closer to the drive cam 24*a* than the pivot position. A portion of the locker arm at the intake valve mechanism 51A side including the pivot position is supposed to be the pivot member 61, and a portion of the locker arm which is closer to the drive cam 24*a* is supposed to be the driven member 63. The pivot member 61 and the driven member 63 are integrally angularly displaceable around the control shaft 60 during the rotation of the drive cam 24*a*, while allowing the driven member 63 to change the relative attitude with respect to the pivot member 61.

Since the stop winding portion 77*d* of the one end 77*b* of the coil spring 77 is wound around and stopped by the stop groove 62*c* formed in the coupling pin 62 as described above, a stop member for exclusive use need not be provided. In addition, since the stop groove portion 62*c* has a substantially semicircular cross-section, the contact surface pressure between the stop groove portion 62*c* and the stop winding portion 77*d* which is formed by the round rod member and has a substantially circular cross-section is reduced, lessening wear-out of these constituents. In addition, since the opposite end 77*c* of the coil spring is sandwiched between the mounting portion 78 and the lower bracket 81, a member exclusively for retaining the opposite end 77*c* need not be provided. As a result, the components are reduced in number.

Since the coil spring 77 is mounted as described above, the driven member 63 is subjected to a force in one direction around the control shaft 60, and the drive cam contact portion 75 contacts the drive cam 24*a*. Also, the lever portion 63*b* contacts the roller 71. As viewed along the center axis of the insertion portion 63*a* of the driven member 63, the drive cam 24 and the roller 71 are located in one of two regions defined by a straight line L (see FIG. 10) passing through the tip end of the drive cam contact portion 75 and the tip end of the lever portion 63*b*. The circular-arc sliding contact surface 75*a* contacting the drive cam 24*a*, and the surface of the lever portion 63*b* contacting the roller 71 are directed toward the one region with respect to the straight line L.

An output shaft of the motor 87 (see FIG. 9) is coupled to the control shaft 60 of the pivot cam mechanism 48. The motor 87 is driven so that the control shaft 60 is rotated a desired angle around the center axis 60*a* thereof so as to change the phase. As described later, when the control shaft 60 is rotated to change the phase of the roller 71 around the center axis 60*a*, the lever portion 63*b* contacting the roller 71 moves, changing the relative attitude of the driven member 63 with respect to the pivot member 61. According to the attitude change, the timing at which the driving power is transmitted from the drive cam 24*a* to the intake valve mechanism 51A and the displacement amount of the intake valve mechanism 51A are changed, changing the lift characteristics of the intake valve mechanism 51A. In this way, the roller 71 and the lever portion 63*b* form a relative attitude changing mechanism 64 for changing the relative attitude of the driven member 63 with respect to the pivot member 61 to change the lift characteristics of the intake valve mechanism 51A.

As shown in FIG. 3, the pivot member 61 and the driven member 63 included in the pivot cam mechanism 48 are configured to open toward the center in the forward and rearward direction of the engine E. To be specific, the tappet pressing portion 74 of the pivot member 61 extends from the control shaft 60 toward a center in the forward and rearward direction of the engine E. The drive cam contact portion 75 of the driven member 63 extends upward from the control shaft 60 toward the center in the forward and rearward direction of the engine E. Therefore, the pivot member 61 and the driven member 63 are configured to open at an acute angle from the control shaft 60 as a base end toward the center in the forward and rearward direction of the engine E.

In this embodiment, the drive cam 24*a* in the air-intake system of FIG. 3 is configured to rotate counterclockwise, and the drive cam 24*a* at the exhaust side is configured to rotate counterclockwise as in the drive cam 24*a* at the intake side.

As shown in FIG. 3, a shaft support bracket 49 is provided on the upper surface of the cylinder head 20 to support the drive camshaft 24 such that the drive camshaft 24 is rotatable. The shaft support bracket 49 includes a lower bracket 81 protruding from the upper surface of the cylinder head 20 and an upper bracket 82 mounted to the lower bracket 81 from above by bolts 80. The lower bracket 81 has a lower bearing recess 81*a* having a semicircular cross-section. The upper bracket 82 has an upper bearing recess 82*a* with a semicircular cross-section, facing the lower bearing recess 81*a*. The drive camshaft 24 is rotatably inserted and supported in a bearing space with a circular cross-section which is defined by the lower bearing recess 81*a* and the upper bearing recess 82*a*.

A insertion hole 81*b* is formed on the lower bracket 81 to penetrate along the center axis direction of the drive camshaft 24. An oil pipe 83 is inserted into the insertion hole 81*b*. Therefore, there is no need to provide a member exclusively for supporting the oil pipe 83. Thus, the number of components is reduced, and space saving is attained. Two oil pipes 83 are provided between the valve operating system 50A included in the air-intake system and the valve operating system 50B included in the air-exhaust system. A plurality of outlets 83*a* are formed on the peripheral wall of the oil pipe 83 such that they are spaced apart from each other in the longitudinal direction thereof. The outlets 83*a* are provided at locations respectively corresponding to the valve operating system 50A. The oil flowing in the oil pipe 83 is ejected toward the valve operating system 50A through the outlets 83*a*.

The outlets 83*a* of the oil pipe 83 are located in close proximity to the tip end portion of the drive cam contact portion 75 of the driven member 63. To be specific, the oil pipe 83 is disposed in a space formed between the pivot cam mechanism 48 in the air-intake system and the pivot cam mechanism 48 in the air-exhaust system. The outlets 83*a* of the oil pipe 83 are disposed to face contact surfaces of the driven member 63 and the drive cam 24*a* in at least one position in the movable range of the pivot cam mechanism 48.

Figure 8:
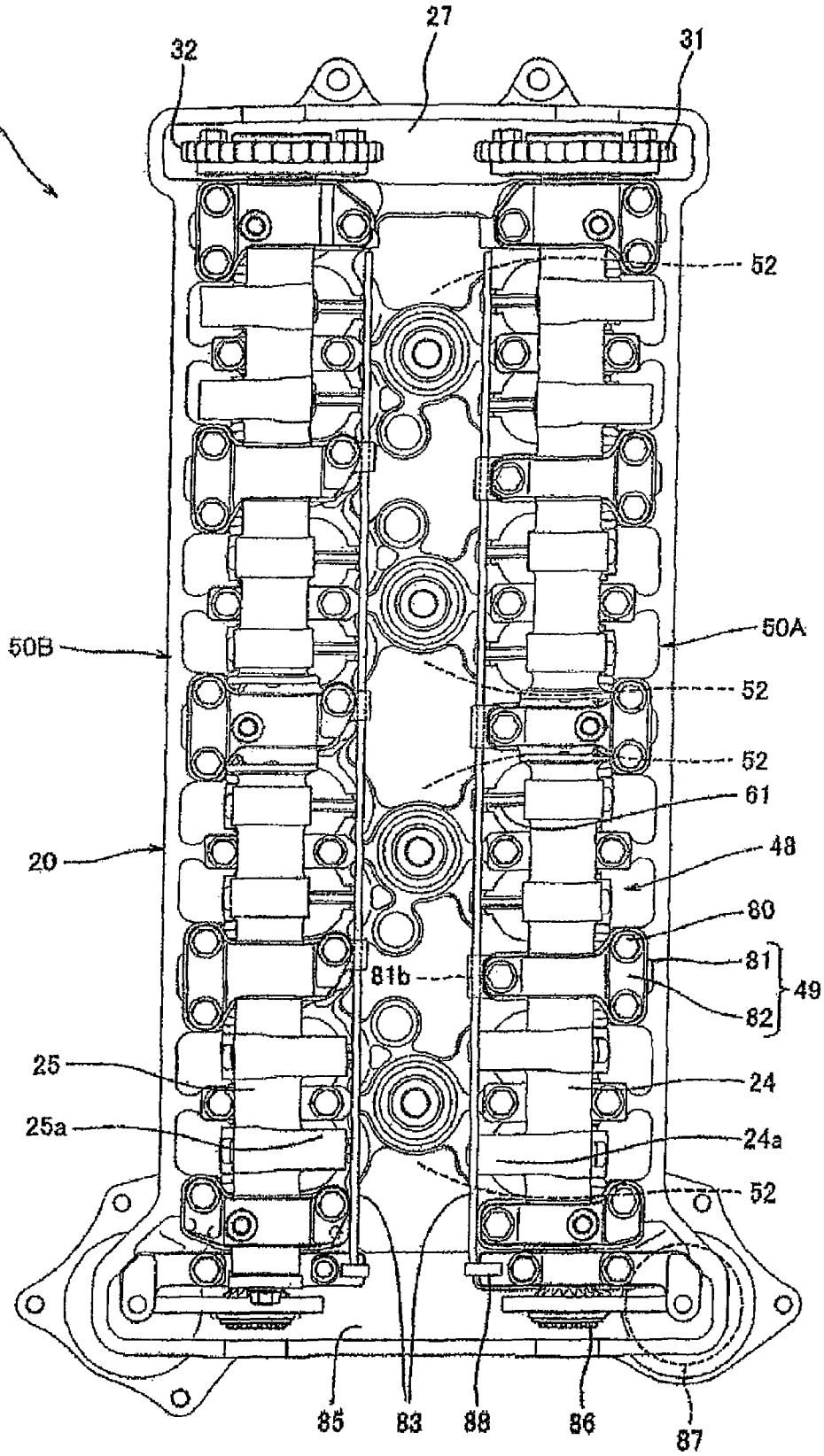
FIG. 8 is a plan view showing a state where a head cover is removed from the engine of FIG. 3.
Figure 9:
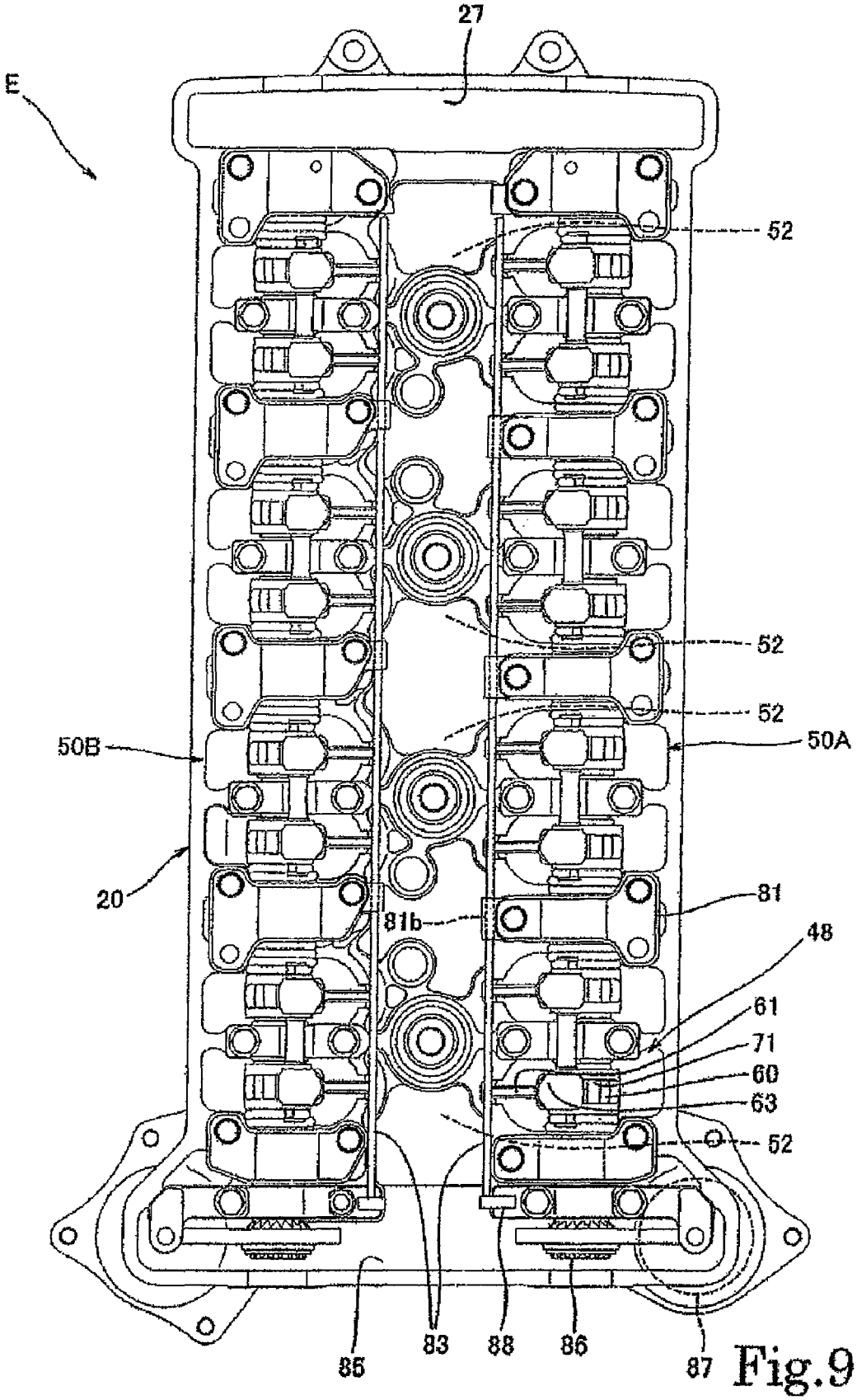
FIG. 9 is a plan view showing a state where upper brackets and drive camshafts are further removed from the engine of FIG. 8.

FIG. 8 is a plan view showing a state where the head cover 21 is removed from the engine E of FIG. 3. FIG. 9 is a plan view showing a state where the upper brackets 82 and the drive camshafts 24 and 25 are further removed from the engine E of FIG. 8. As shown in FIG. 8, the valve operating system 50A in the air-intake system is aligned in one line at one side relative to the combustion chambers 52 arranged in one line in the rightward and leftward direction, while the valve operating system 50B in the air-exhaust system is aligned in one line at the other side. The drive camshafts 24 and 25 extend along the direction in which the valve operating systems 50A and 50B are aligned. As described above, the end portions of the drive camshafts 24 and 25 are respectively coupled to the cam sprockets 31 and 32 inside the chain tunnel 27.

As shown in FIG. 9, the control shaft 60 extends along the direction in which the valve operating systems 50A and 50B are aligned. A gear chamber 85 is provided at an end portion of the engine E which is opposite to the chain tunnel 27. A control gear 86 configured to mesh with the control shaft 60 is accommodated in the gear chamber 85. The control gear 86 is driven by the motor 87 attached to the cylinder head 20, and in association with this, the control shaft 60 rotates. The operation of the motor 87 is controlled by an ECU (electronic control unit) (not shown) which is built into the motorcycle 1.

As shown in FIGS. 8 and 9, a pair of oil pipes 83 are disposed to extend along the direction (rightward and leftward direction) in which the valve operating systems 50A and 51A are aligned, between the pivot cam mechanisms 48 in the air-intake system and the pivot cam mechanisms 48 in the air-exhaust system. One end portion of the oil pipe 83 is coupled to a pipe connecting portion 88 provided at the upper surface of the cylinder head 20. The pipe connecting portion 88 has an oil supply passage (not shown) in which the oil suctioned up by the oil pump 44 from the oil pan 29 flows. Through the oil supply passage, the oil is fed to the oil pipe 83.

[Operation Principle]

Figure 10:
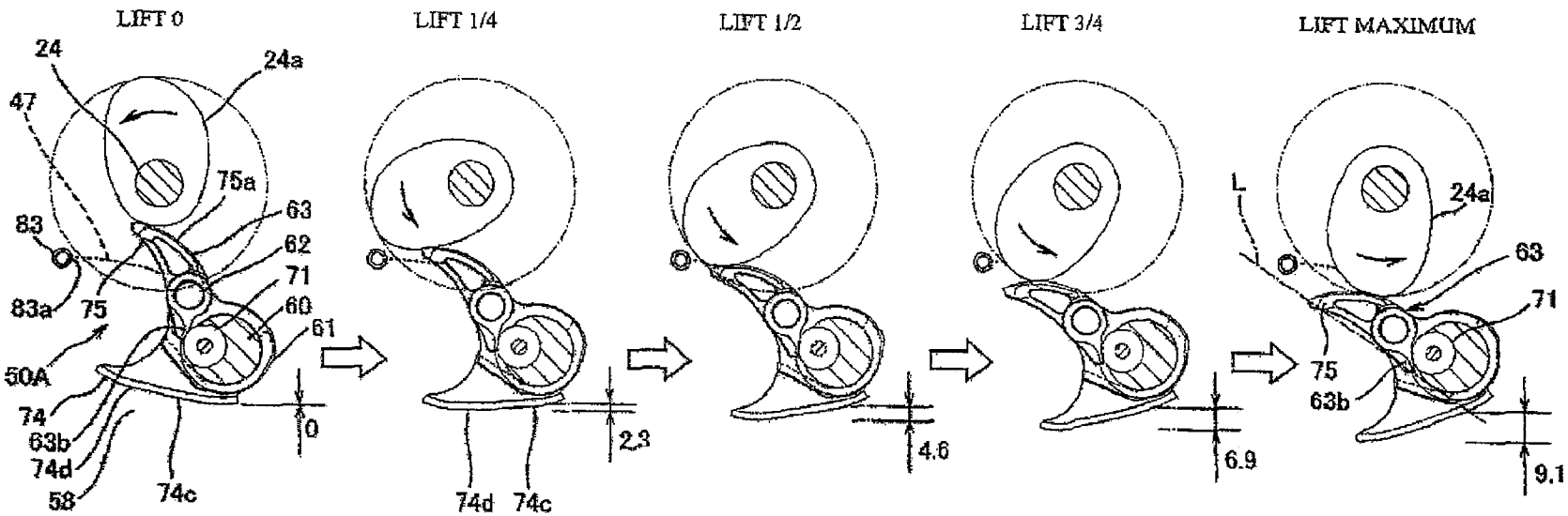
FIG. 10 is a view showing an operation of the valve operating system in a state where the pivot cam mechanism is set in one mode.

Subsequently, the operation principle of the valve operating system 50A according to this embodiment will be described. FIG. 10 is a view showing an operation of the valve operating system 50A in a state where the pivot cam mechanism 48 is set in one mode. In this mode, the pivot member 61 and the driven member 63 in the pivot cam mechanism 48 are open with a relatively large angle. As shown in FIG. 10, when the tip end portion (to be precise, tip end of a cam nose) of the drive cam 24*a* is located at an upper limit position, the base circular arc surface 74*c* of the tappet pressing portion 74 of the pivot member 61 is in contact with the tappet 58 (actually, there is a minute clearance between the base circular arc surface 74*c* and the tappet 58). Therefore, the lift amount of the tappet 58 (i.e., lift amount of the valve body 53) is substantially zero, and the valve body 53 closes the intake port 20A. The drive cam contact portion 75 of the driven member 63 in this case is applied with a force by the coil spring 77 via the coupling pin 62 toward one direction (counterclockwise in FIG. 10) around the center axis 60*a* of the control shaft 60 so that the drive cam contact portion 75 is pressed against the drive cam 24*a*. In this case, the lever portion 63*b* of the driven member 63 is in contact with the roller 71, and therefore, angular displacement of the insertion portion 63*a* in one direction around the center axis 60*a* is inhibited.

When the drive cam 24*a* rotates (rotates counterclockwise in FIG. 10), and the cam nose moves down, the drive cam contact portion 75 of the driven member 63 is pressed down by the drive cam 24*a*. At this time, since the lever portion 63*b* is in contact with the roller 71, and therefore the angular displacement of the driven member 63 in one direction (counterclockwise direction in FIG. 10) around the coupling pin 62 is inhibited, the driven member 63 causes the coupling pin 62 to be angularly displaced around the control shaft 60. The driven member 63 and the pivot member 61 which are coupled to each other via the coupling pin 62 are integrally angularly displaced and pivoted around the control shaft 60. In this construction, the lift amount of the tappet 58 is zero while the base circular arc surface 74*c* of the pivot cam 61 is sliding on the upper surface of the tappet 58. When the pivot cam 61 further rotates and the lift curved surface 74*d* slides on the upper surface of the tappet 58, the tappet 58 is pressed down according to the rotation of the pivot member 61, and at the same time, the valve body 53 is displaced downward, increasing the lift amount. As a result, the intake port 20A is opened.

As described above, there is a minute clearance between the base circular arc surface 74*c* of the pivot member 61 and the upper surface of the tappet 58. Therefore, they do not slide and the base circular arc surface 74*c* moves with respect to the upper surface of the tappet 58 in the state where the pivot member 61 and the tappet 58 face each other with the clearance during a period in which the base circular arc surface 74*c* is opposite to the upper surface of the tappet 58, to be precise.

The outlets 83*a* of the oil pipe 83 are oriented to face sliding portions of the driven member 63 and the drive cam 24*a* (without being disturbed by the drive cam contact portion 75 of the driven member 63) in at least a position of a movable range of the pivot cam mechanism 48 operable as described above. In this structure, during the operation of the valve operating system 50A, oil 47 ejected through the outlets 83*a* of the oil pipe 83 is directly applied to the sliding surfaces of the driven member 63 and the drive cam 24*a*. Thus, the oil 74 is sufficiently fed to the sliding surfaces and an oil film is formed stably on the sliding surfaces. As a result, durability of the valve operating system 50A against wear-out and the like can be improved.

Figure 11:
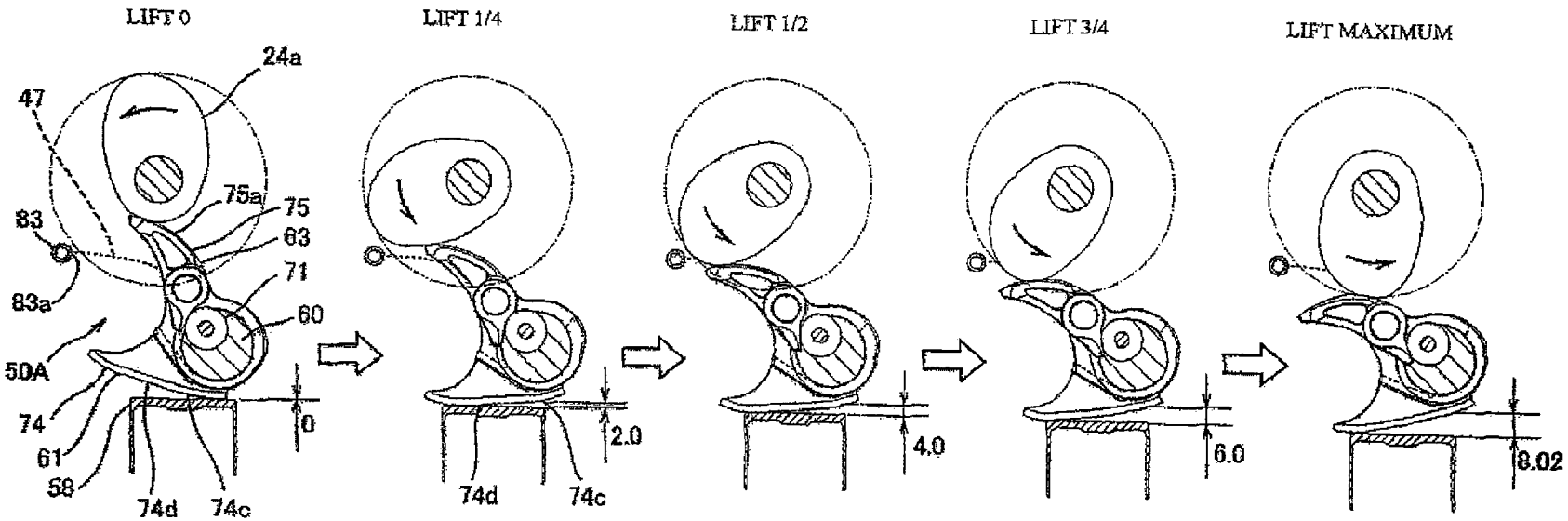
FIG. 11 is a view showing an operation of the valve operating system in a state where the pivot cam mechanism is set in another mode.

FIG. 11 is a view showing an operation of the valve operating system 50A in a state where the pivot cam mechanism 48 is set in another mode. As shown in FIG. 11, when the control shaft 60 rotates counterclockwise in FIG. 11, the roller 71 moves according to the rotation. Thereby, the contact position of the lever portion 63*b* of the driven member 63 with respect to the roller 71 changes, changing the relative attitude of the driven member 63 with respect to the pivot member 61. In the mode shown in FIG. 11, the pivot member 61 and the driven member 63 in the pivot mechanism 48 are open with a smaller angle than the pivot member 61 and driven member 63 in the mode shown in FIG. 10.

Thereby, the operation timing and lift amount of the valve body 53 which is pressed down by the pivot member 61 via the tappet 58 are changed. To be specific, as shown in FIG. 11, the lift amount is smaller and the open time of the intake port 20A which is opened by the valve body 53 is shorter. Even when the relative attitude of the driven member 63 with respect to the pivot member 61 is changed as shown in FIG. 11, the outlets 83*a* of the oil pipe 83 are disposed to face sliding portions of the driven member 63 and the drive cam 24*a* in at least one position in the movable range of the pivot cam mechanism 48 (without being disturbed by the drive cam contact portion 75 of the driven member 63). Therefore, even in this mode, the oil film can be formed stably.

As should be understood from the structure and operation of the pivot mechanism 48 described above, the members of the pivot mechanism 48 of this embodiment which move during the rotation of the drive cam 24*a* are advantageously fewer. In addition, the coupling pin 62 has a hollow pipe shape and is lightweight. Thereby, an increase in an inertia moment during the operation can be suppressed. Furthermore, by changing the relative attitude of the driven member 63 with respect to the pivot member 61 according to the angular displacement of the control shaft 60, the lift characteristics of the intake valve mechanism 51A can be changed.

In the pivot cam mechanism 48 according to this embodiment, the control shaft 60 and the roller 71 are separate members. By suitably selecting the roller 71 from among the rollers having various shapes and dimensions and supporting it by the roller shaft 68, various lift characteristics are easily attainable.

Whereas in this embodiment, the valve operating systems 50A and 50B have substantially the same structure as described above, for example, the outer shapes of the drive cams 24*a* (contours as viewed along the center axis direction of the drive camshaft 24) may be different between the air-intake system and the air-exhaust system. This can make the flow rates and timings for air-intake and air-exhaust different from each other while using the pivot members 61 and the driven members 63 which are identical in shape in the air-intake system and in the air-exhaust system. With regard to the relative attitude changing mechanism 64 including the lever portion 63*b*, the roller 71, and others, the members, which are identical in shape, may be used in the air-intake system and in the air-exhaust system, or otherwise, the outer shape of one or both of the pivot member 61 and the driven member 63 may be made different between the air-intake system and the air-exhaust system.

[Mechanical Structure of Pivot Cam Mechanism]

Figure 12B:
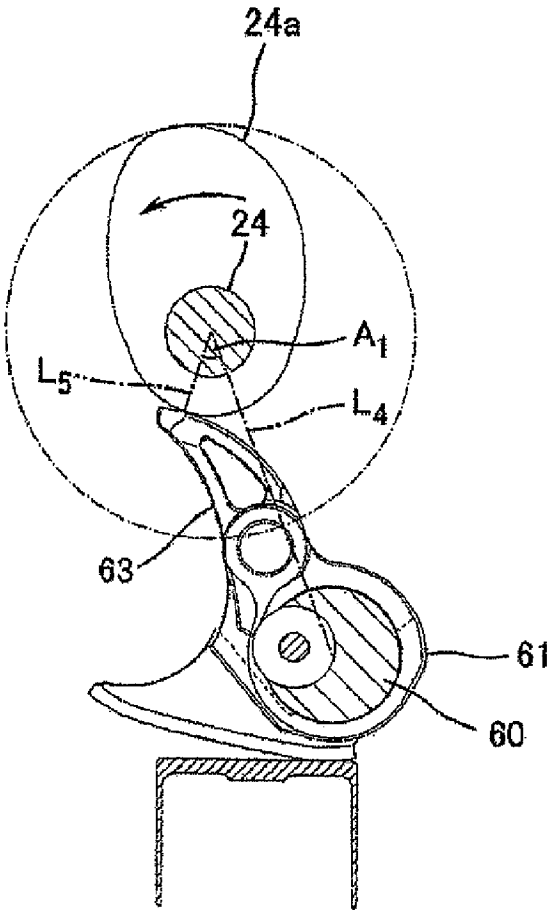
FIG. 12 is a schematic side view of the valve operating system including the pivot cam mechanism, wherein FIG. 12(*a*) is a view showing the positional relationship between a control shaft, a coupling pin, and a drive camshaft, and the relationship between forces acting on a driven member, and FIG. 12(*b*) is a view showing a contact position of the driven member and the drive cam.
Figure 12A:
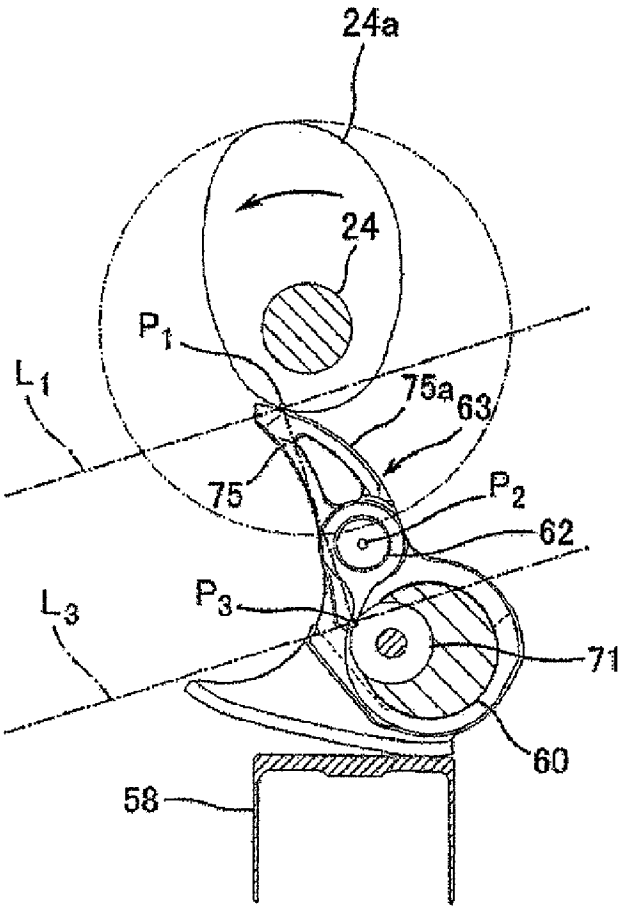

FIG. 12 is a schematic side view of the valve operating system 50A including the above described pivot cam mechanism 48, in which FIG. 12(*a*) is a view showing the positional relationship between the control shaft 60, the coupling pin 62, and the drive camshaft 24, and the relationship between the forces acting on the driven member 63, and FIG. 12(*b*) is a view showing the contact position of the driven member 63 and the drive cam 24*a*. As described above, the outer peripheral surface of the tappet pressing portion 74 of the pivot member 61 supported by the control shaft 60 set in a predetermined phase is in contact with the tappet 58. The lever portion 63*b* of the driven member 63 supported by the pivot member 61 via the coupling pin 62 is in contact with the roller 71 and the circular-arc sliding contact surface 75*a* of the drive cam contact portion 75 is in contact with the drive cam 24*a*.

In the positional relationship between the control shaft 60, the coupling pin 62, and the drive camshaft 24 in FIG. 12(*a*), the coupling pin 62, which is an example of the second support shaft, is located closer to the drive camshaft 24 than the control shaft 60, which is an example of the first support shaft. Since the coupling pin 62 supporting the driven member 63 is separate from the control shaft 60, the size of the insertion portion 63*a* (see FIG. 4) can be reduced by reducing the diameter of the coupling pin 62. This contributes to reduction of the size of the driven member 63. By reducing the size of the driven member 63 and the coupling pin 62, the weight of the portion distant from the control shaft 60 is reduced, enabling reduction in the inertia moment around the control shaft 60.

In the relationship of the forces acting on the driven member 63 in FIG. 12(*a*), the contact point between the circular-arc sliding contact surface 75*a* of the driven member 63 and the drive cam 24*a* form a force point P1, the center axis position of the coupling pin 62 by which the driven member 63 is rotatably supported form a force application point P2, and the contact point between the lever portion 63*b* of the driven member 63 and the roller 71 form a fulcrum point P3. In the valve operating system 50A of this embodiment, the force application point P2 is located between two straight lines L1 and L3 respectively passing through the force point P1 and the fulcrum point P3 so as to cross at a right angle a line segment connecting the force point P1 to the fulcrum point P3. Thus, the force application point P2 is set closer to the fulcrum point P3 than the force application point P1 to enable the driving power to be efficiently transmitted from the drive cam 24*a* to the pivot member 61.

Since the force application point P2 is set closer to the fulcrum point P3 than the force application point P1, the driving power can be efficiently transmitted from the drive cam 24*a* to the pivot member 61, while reducing the size of the driven member 63 as compared to the configuration in which the force application point P2 is located outside the range between the straight lines L1 and L3. In addition, by reducing the size of the driven member 63, the inertia moment of the driven member 63 can be reduced, and a PV value can be reduced.

Subsequently, the contact position of the driven member 63 and the drive cam 24*a* will be described with reference to FIG. 12(*b*). When the line segment connecting the center axis of the drive cam 24*a* to the center axis of the pivot member 61 is expressed as a first line segment L4 and the line segment connecting the contact point (force point P1) between the drive cam 24*a* and the driven member 63 to the center axis of the drive cam 24*a* is expressed as a second line segment L5, a set angle A1 formed between the line segments L4 and L5 is set to an acute angle (i.e., 90 degrees>A1>0) which is more preferably in a range between 35 degrees and 45 degrees. In more detail, the set angle A1 is set to an angle formed between the line segments L4 and L5 when the pivot member 61 rotates to a maximum degree (in other words, when the contact point between the driven member 63 and the drive cam 24*a* is closest to the center axis of the drive cam 24*a*) in the state where the control shaft 60 is set in a maximum rotation amount in an angular displacement direction (counterclockwise in FIG. 12(*b*)) for increasing the maximum lift amount of the valve body 53 when the drive cam 24*a* rotates and the angle formed between the pivot member 61 and the driven member 63 is set to a maximum value. This makes it possible to reduce the PV value at the contact portions of the drive cam 24*a* and the driven member 63, i.e., a multiplication value (P×V) of the surface pressure (P) and the sliding speed (V) at the contact portions. As a result, wear resistance at the contact portions is improved.

Figure 13:
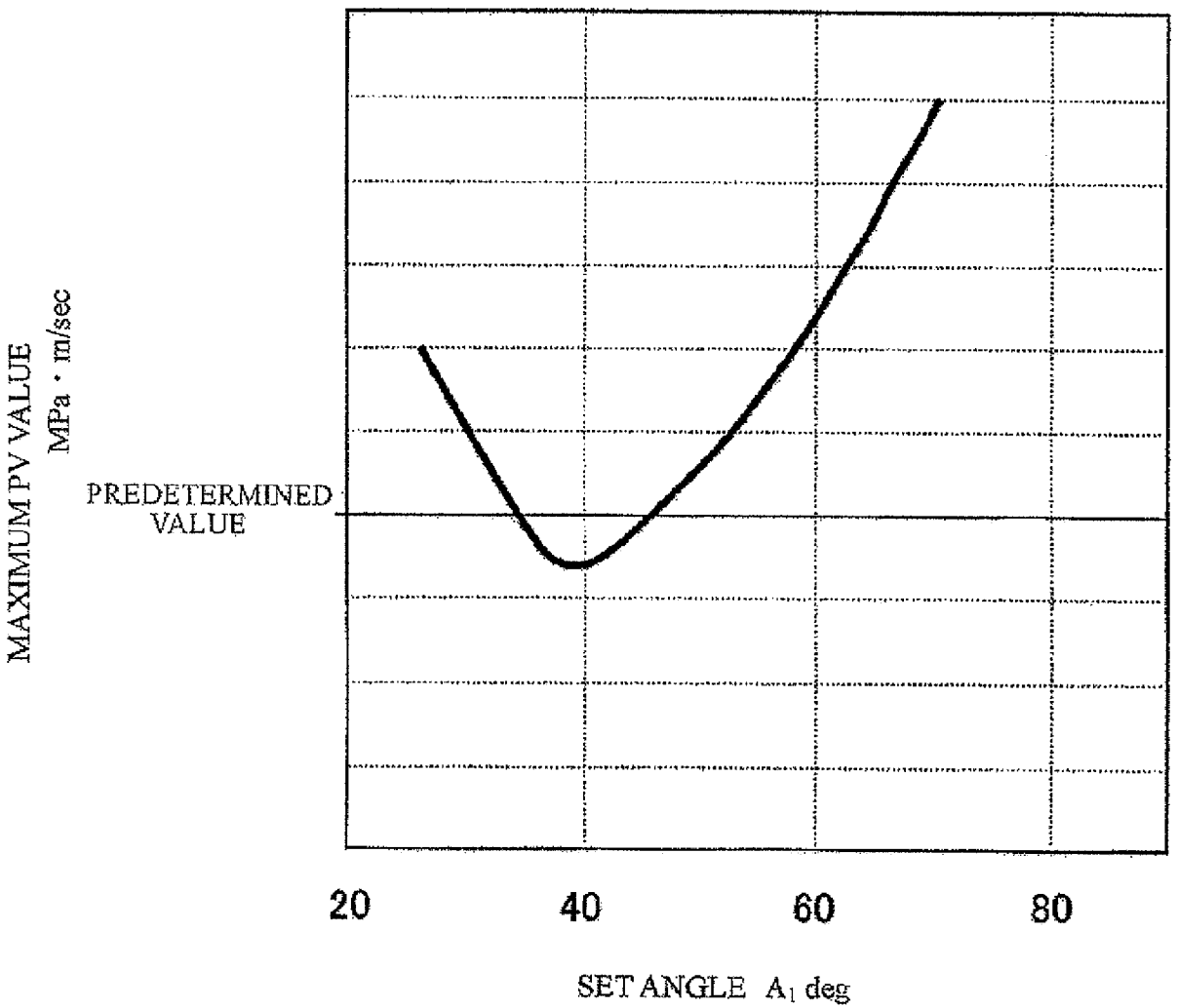
FIG. 13 is a graph showing an example of the relationship between a set angle of FIG. 12 and a PV value.

FIG. 13 is a graph showing an example of the relationship between the set angle A1 and the PV value. Herein, the PV value indicates a maximum value occurring when the set angle A1 is set to a certain value. As shown in FIG. 13, the maximum value of the PV value has a minimum value when the set angle A1 is near 40 degrees and increases as the set angle A1 increases from near 40 degrees and decreases from near 40 degrees. The PV value is less than a predetermined value in a range between 35 degrees and 45 degrees.

Now, the relationship between the set angle A1 and the PV value will be considered. As the set angle A1 is reduced, the distance from the center axis of the control shaft 60 to the contact point P1 can be reduced and the driven member 63 can be made short, so that the inertia moment can be reduced. There is a likelihood that a cam top radius (distance from the center axis of the drive cam 24*a* to the cam nose) of the drive cam 24*a* can be reduced by reducing the set angle A1 in the structure according to this embodiment, thereby reducing the maximum value of the V value. Supposing that the lift characteristics of the valve body 53 during one rotation of the drive cam 24*a* are fixed, the contact portions of the drive cam and the driven member are closer to the center of the angular displacement of the pivot member due to reduction of the dimension of the driven member 63 according to the reduced set angle A1, and therefore the PV value tends to be large, because the moment acting on the driven member 63 needs to be invariable in principle.

As should be understood from the above, to reduce the PV value, it cannot be said that as small a set angle as possible is preferred, rather there is an optimal value of the set angle A1. In light of this, the inventors discovered that the set angle A1 is preferably an acute angle, which is more preferably, in a range between 35 degrees and 45 degrees. Alternatively, a simulation program may be used to obtain the set angle A1 with which the maximum PV value becomes the smallest, and the respective members and constituents may be designed so that the set angle A1 becomes close to the obtained set angle A1.

The parameters which may affect the PV value include the shape of the circular-arc sliding contact surface 75*a* of the drive cam contact portion 75 of the driven member 63, the shape of the outer peripheral surface of the drive cam 24*a*, the dynamic friction coefficient of the contact portions, etc, as well as the above described set angle A1. Nonetheless, the degree (sensitivity) in a change of the PV value occurring when the set angle A1 is changed is relatively large. Therefore, the PV value is easily reduced by controlling the set angle A1 rather than controlling these parameters. Having described above the valve operating system 50A associated with the intake port 20A, the same advantages are achieved with the same configuration, in the valve operating system 50B associated with the exhaust port 20B.

Since the valve operating system 50A or 50B described above is mainly comprised of relatively few constituents, which are the control shaft 60, the pivot member 61, the driven member 63, and the coil spring 77, assembly precision can be improved and a manufacturing cost can be reduced. In addition, since the coupling pin 62 supporting the driven member 63 is attached to the pivot member 61, the relative positions of the control shaft 60 supporting the pivot member 61 and the coupling pin 62 can be determined accurately.

Since the roller 71 constituting the relative attitude changing mechanism 64 is mounted in the vicinity of the center axis of the control shaft 60 rather than distant from the control shaft 60, the inertia moment around the control shaft 60 is reduced in the pivot cam mechanism 48. Furthermore, since the circular-arc sliding contact surface 75*a* of the drive cam contact portion 75 of the driven member 63 is a surface subjected to a hardening process and the oil 47 is directly fed to the sliding portions of the drive cam 24*a* and the circular arc sliding contact surface 75*a*, the oil film is stably formed between the drive cam 24*a* and the driven member 63.

[Acceleration Curve of Valve Body and Pivot Member]

Figure 14A:
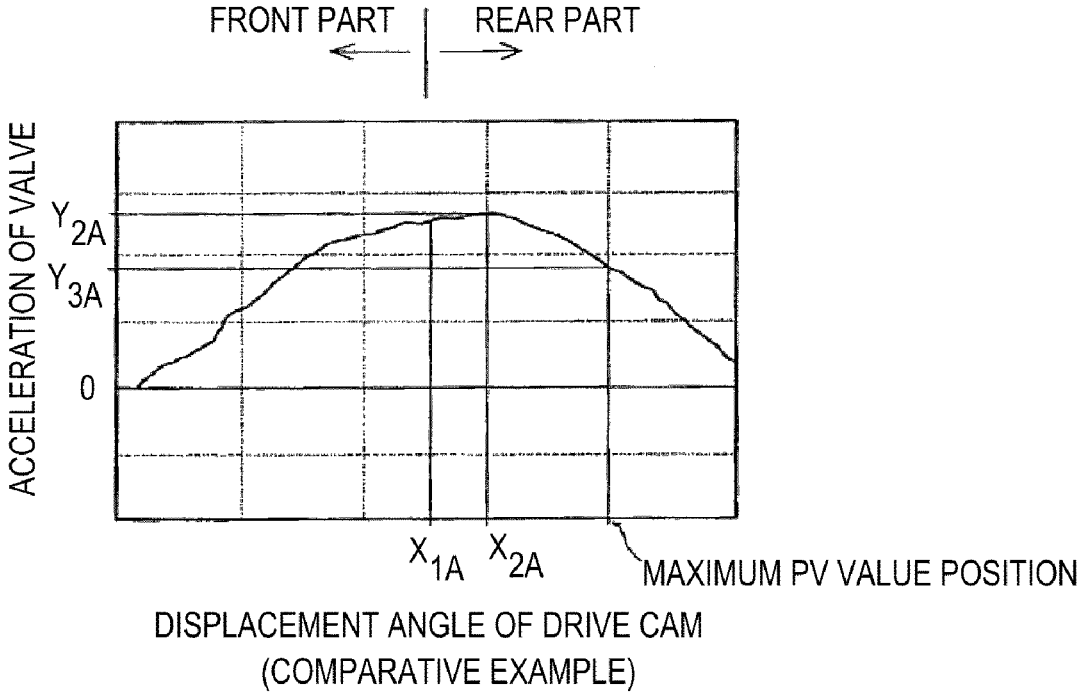
FIG. 14 is a graph showing a change in an acceleration of a valve body in the valve operating system according to this embodiment, wherein FIG. 15(*a*) shows a change in an acceleration of a valve body according to a comparative example, and FIG. 15(*b*) shows a change in an acceleration of a valve body in the valve operating system according to this embodiment.
Figure 14B:
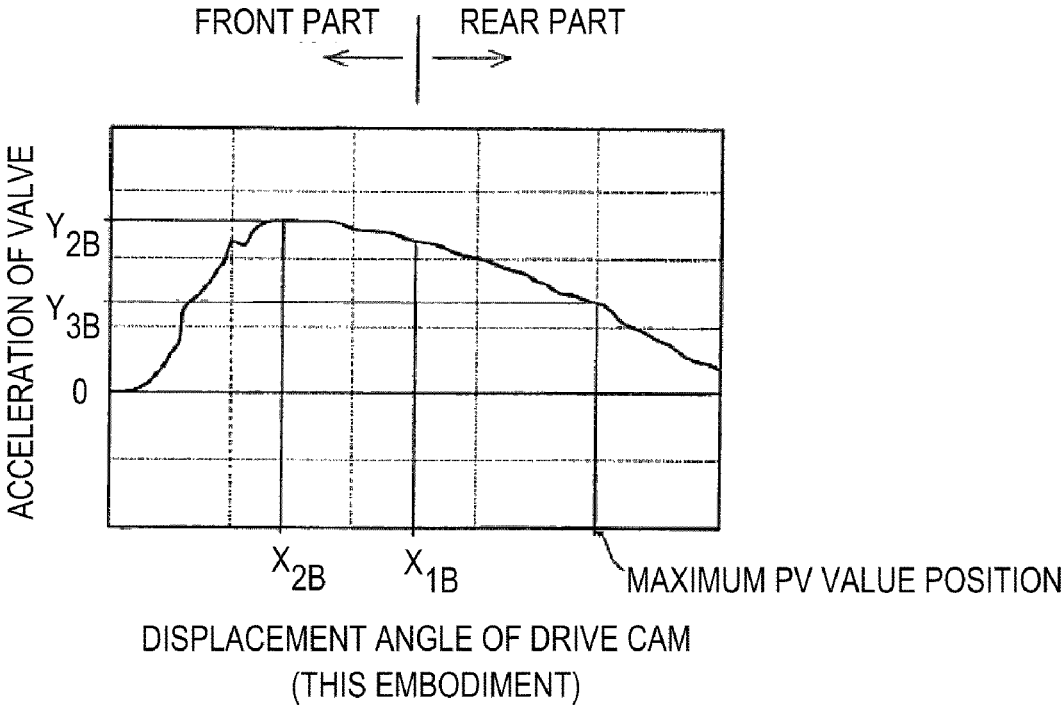
Figure 15A:
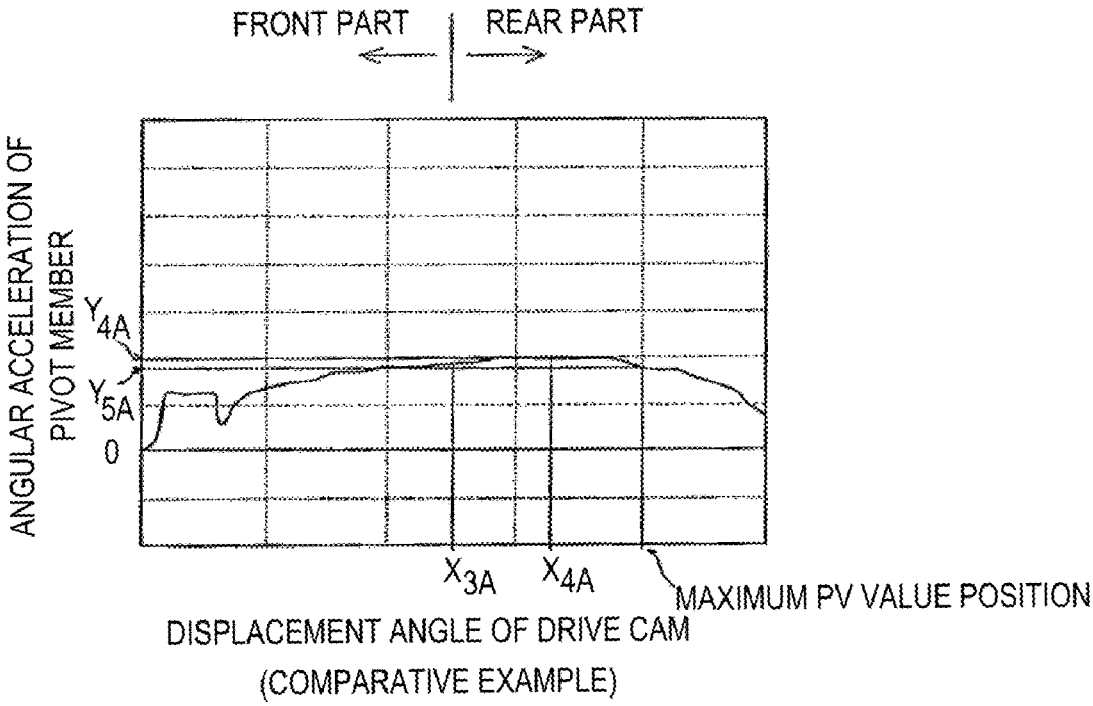
FIG. 15 is a graph showing a change in an angular acceleration of a pivot member according to this embodiment, in which FIG. 15(*a*) shows a change in an angular acceleration of a pivot member according to a comparative example and FIG. 15(*b*) shows a change in an angular acceleration of a pivot member of the valve operating system according to this embodiment.
Figure 15B:
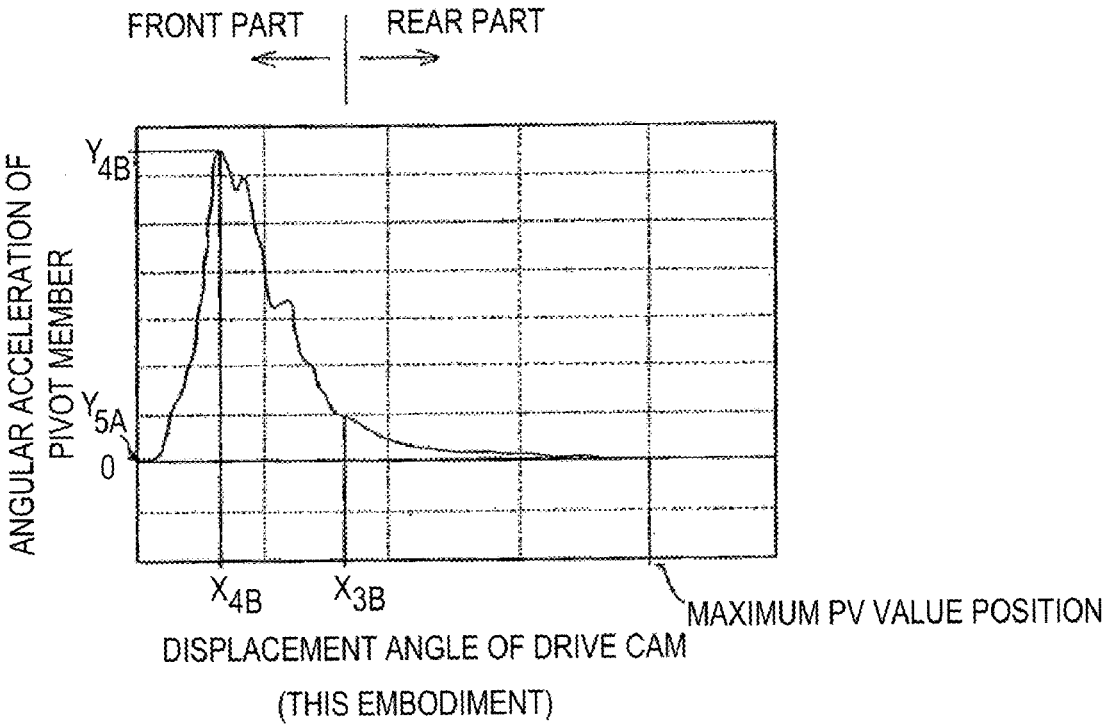
Figure 16:
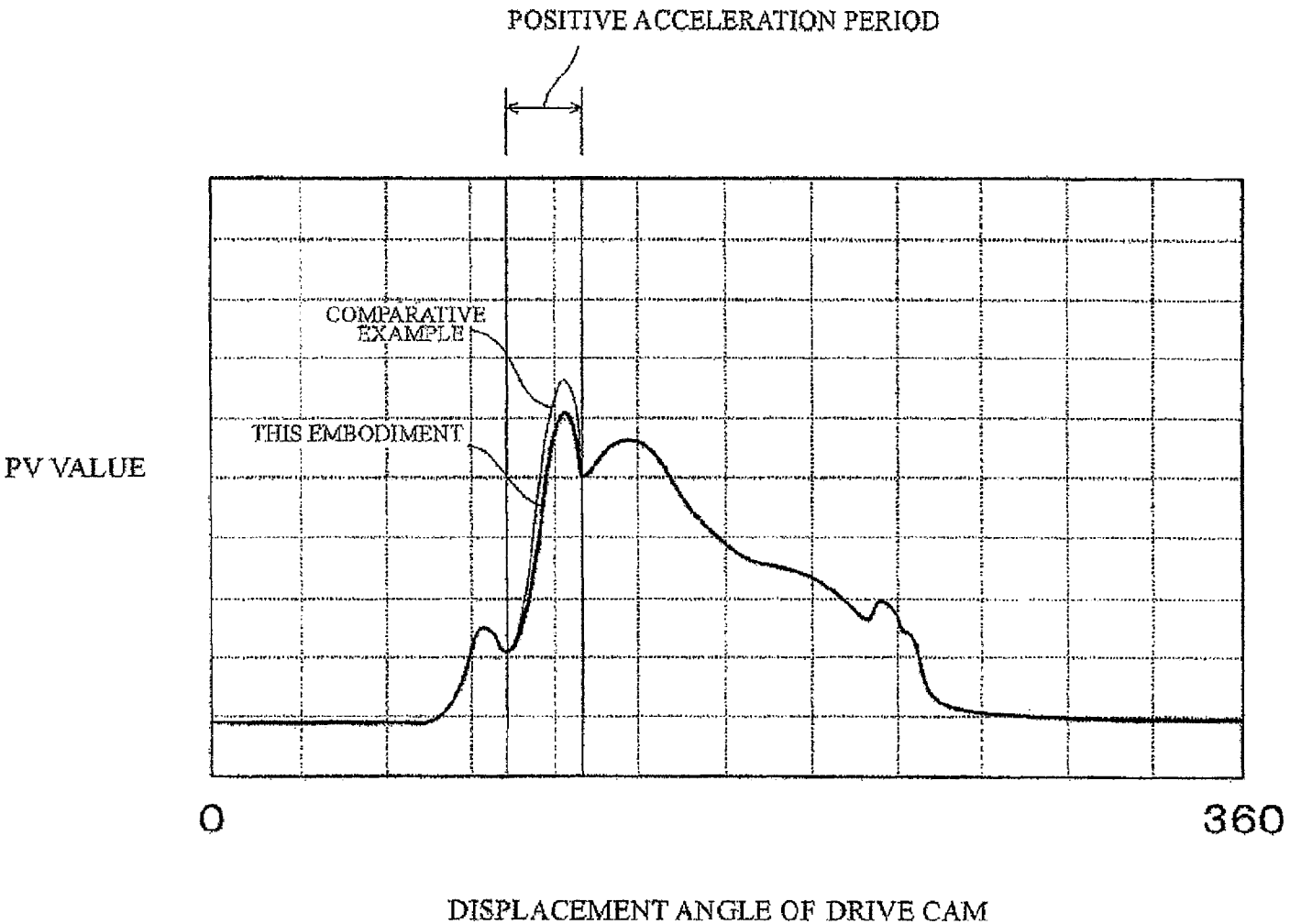
FIG. 16 is a graph showing a change in the PV value at contact portions of the drive cam and the driven member with respect to the angular displacement of the drive cam in the valve operating system according to this embodiment, wherein a horizontal axis indicates the angular displacement of the drive cam, a vertical axis indicates the PV value, a thin line indicates those of a comparative example, and a bold line indicates those of the valve operating system of this embodiment.

FIG. 14 is a graph showing a change in an acceleration of valve body 53 in the valve operating system 50A or 50B as described above, in which FIG. 14(*a*) shows a change in an acceleration according to comparative example, and FIG. 14(*b*) shows a change in an acceleration in the valve operating system 50A or 50B according to this embodiment. In FIGS. 14(*a*) and 14(*b*), a horizontal axis indicates a displacement angle of the drive cam 24*a* and a valve acceleration period in which the valve body 53 has a positive acceleration while the drive cam 24*a* is rotating once, and a vertical axis indicates an acceleration of the valve body 53. FIG. 15 is a graph showing a change in an angular acceleration of the pivot member 61, wherein FIG. 15(*a*) shows a change in an angular acceleration according to a comparative example and FIG. 15(*b*) shows a change in an angular acceleration in the valve operating system 50A or 50B according to this embodiment. In FIGS. 15(*a*) and 15(*b*), a horizontal axis indicates a displacement angle of the drive cam 24*a* and a pivot member acceleration period in which the pivot member 61 has a positive acceleration while the drive cam 24*a* is rotating once, and a vertical axis indicates an angular acceleration of the pivot member 61. FIG. 16 is a graph showing a change in the PV value at contact portions of the drive cam 24*a* and the driven member 63 with respect to the angular displacement of the drive cam 24*a* in the valve operating system 50A or 50B according to this embodiment, wherein a horizontal axis indicates the angular displacement of the drive cam, a vertical axis indicates the PV value, a thin line indicates those according to a comparative example, and a bold line indicates those of the valve operating system 50A or 50B of this embodiment.

When the drive cam 24*a* rotates, the contact portions of the drive cam 24*a* and the driven member 63 slide and the contact portions of the pivot member 61 and the valve body 53 (to be precise, tappet 58) slide. As shown in FIG. 14(*a*), in the valve operating system according to the comparative example, in the valve acceleration period in which the acceleration of the valve has a positive value while the drive cam is rotating once, a valve maximum acceleration point X2A at which the acceleration of the valve body 53 is a maximum value Y2A is located in a rear part which is rearward relative to an intermediate point X1A. In the valve acceleration period, a change rate of the acceleration of the valve body 53 is larger in a rear part which is rearward relative to the valve maximum acceleration point X2A than in a front part which is forward relative to the valve maximum acceleration point X2A. As shown in FIG. 15(*a*), in the pivot member acceleration period (substantially conforming to the valve acceleration period) in which the angular acceleration of the pivot member has a positive value while the drive cam is rotating once, a pivot member maximum acceleration point X4A at which the angular acceleration of the pivot member 61 is a maximum value Y4A is located in a rear part which is rearward relative to an intermediate point X3A. In the pivot member acceleration period, a change rate of the angular acceleration of the pivot member 61 is larger in a rear part which is rearward relative to the pivot member maximum acceleration point X4A than in a front part which is forward relative to the pivot member maximum acceleration point X4A. As shown by the comparative example (thin line) of FIG. 16, there is a tendency that the PV value at the contact portions is at a maximum in the rear part of each of the valve acceleration period and the pivot member acceleration period. As used herein, the phrase "the acceleration is positive" in the "valve acceleration period in which the acceleration of the valve has a positive value" and "pivot member acceleration period in which the acceleration of the pivot member has a positive value" means that the acceleration occurring when the surface pressure P generated between the drive cam 24*a* and the pivot member 63 increases.

In view of the circumstances, in the valve operating systems 50A or 50B according to this embodiment, the positions and shapes of the drive cam 24*a*, the driven member 63, the pivot member 61, and the roller 71 are designed so that the acceleration of the valve body 53 in the rear part of the valve acceleration period is smaller, to be precise, the valve maximum acceleration point is located in the front part of the valve acceleration period, rather than the rear part of the valve acceleration period in which the PV value tends to be maximum. In addition, the positions and shapes of the drive cam 24*a*, the driven member 63, the pivot member 61, and the roller 71 are designed so that the angular acceleration of the pivot member 61 in the rear part of the pivot member acceleration period is smaller, to be precise, the valve maximum acceleration point is located in the front part of the pivot member acceleration period, rather than the rear part of the pivot member acceleration period in which the PV value tends to be maximum.

Further, the positions and shapes of the drive cam 24*a*, the driven member 63, the pivot member 61, and the roller 71 are designed so that the absolute value of an acceleration change rate of the valve body 53 per unit angular displacement of the drive cam 24*a* is larger in the front part which is forward relative to the valve maximum acceleration point of the valve acceleration period than in the rear part which is rearward relative to the valve maximum acceleration point of the valve acceleration period. Moreover, the positions and shapes of the drive cam 24*a*, the driven member 63, the pivot member 61, and the roller 71 are designed so that the angular acceleration of the pivot member 61 is substantially zero at the position of the drive cam 24*a* where the PV value is at a maximum.

The details will be described with reference to FIGS. 14 and 15. As shown in FIG. 14(*b*), in the valve operating system 50A or 50B according to this embodiment, a valve maximum acceleration point X2B at which the acceleration of the valve body 53 is a maximum value Y2B is located in the front part which is forward relative to the intermediate point X1B of the valve acceleration period. Also, in the valve acceleration period, the change rate of the acceleration of the valve body 53 is smaller in the rear part which is rearward relative to the valve maximum acceleration point X2B than in the front part. As shown in FIG. 15(*b*), in the valve operating system 50A or 50B according to this embodiment, the pivot member maximum acceleration point X4B at which the acceleration of the pivot member 61 is a maximum value Y4B is located in the front part which is forward relative to the intermediate point X3B in the pivot member acceleration period. Also, the angular acceleration of the pivot member 61 is substantially zero at a position where the PV value is at a maximum in the rear part which is rearward relative to the pivot member maximum acceleration point X4B in the pivot member acceleration period.

Thereby, regarding the acceleration of the valve body 53 which occurs when the PV value is at a maximum, the acceleration Y3B of the valve operating system 50A or 50B according to this embodiment of FIG. 14(*b*) is smaller than the acceleration Y3A of the comparative example of FIG. 14(*a*). In addition, regarding the angular acceleration of the pivot member 61 which occurs when the PV value is at a maximum, the angular acceleration Y5B of the valve operating system 50A or 50B according to this embodiment of FIG. 15(*b*) is smaller than the angular acceleration Y5A of the comparative example of FIG. 15(*a*).

Figure 17:
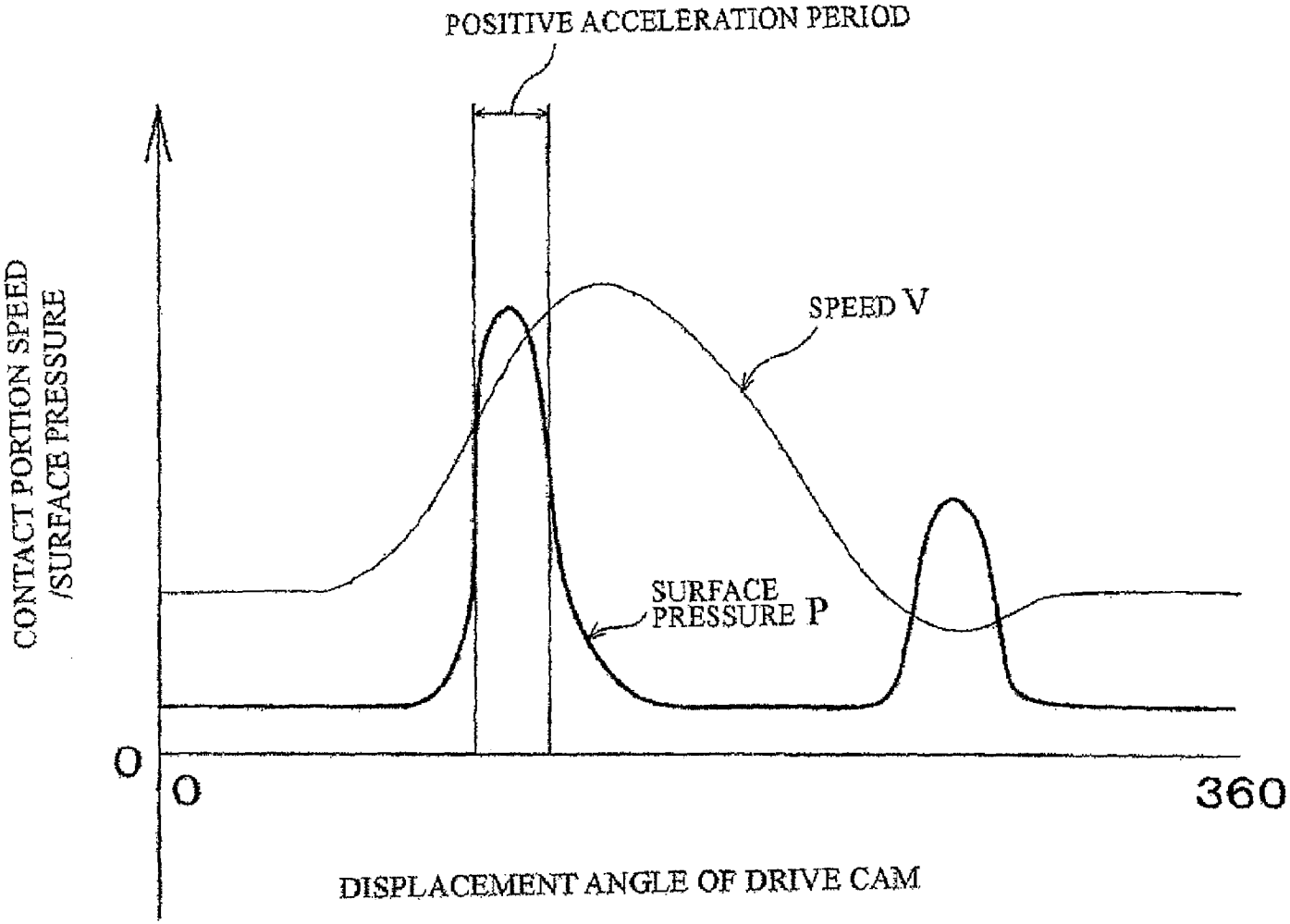
FIG. 17 shows a relative speed of the contact portions of the drive cam and the driven member with respect to the angular displacement of the drive cam in the valve operating system according to this embodiment, wherein a horizontal axis indicates the angular displacement of the drive cam, and a vertical axis indicates a relative speed at the contact portions.
Figure 18:
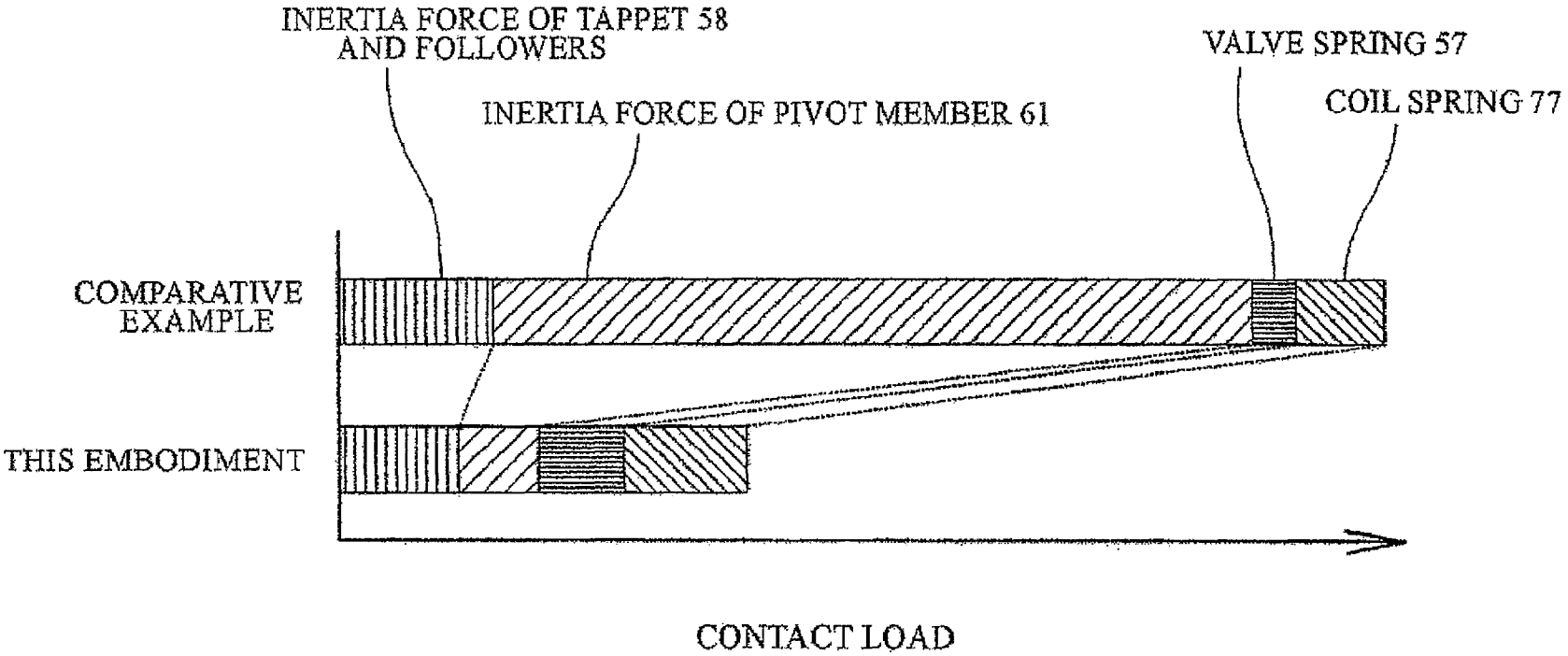
FIG. 18 is a bar graph showing a contact load at the contact portions of the drive cam and the driven member at a point in time when the PV value is at a maximum in the valve operating system according to this embodiment.

FIG. 17 shows the surface pressure P and the relative speed V of the contact portions of the drive cam 24*a* and the driven member 63 with respect to the angular displacement of the drive cam 24*a* in the valve operating system 50A or 50B according to this embodiment, wherein a horizontal axis indicates the angular displacement of the drive cam 24*a*, and a vertical axis indicates the speed V and the surface pressure P of the contact portions. The surface pressure P is indicated by a bold line and the speed V is indicated by a thin line. FIG. 18 is a bar graph showing a contact load at the contact portions of the drive cam 24*a* and the driven member 63 at a point in time when the PV value is at a maximum in the valve operating system 50A or 50B according to this embodiment.

As indicated by the bold line of FIG. 17, by setting the acceleration curves as shown by FIGS. 14(*b*) and 15(*b*), a peak of the surface pressure P at the contact portions of the drive cam 24*a* and the driven member 63 is located in the front part of the valve acceleration period, and as shown in FIG. 18, the contact load at the point where the PV value is at a maximum in the rear part of the valve acceleration period is reduced in the valve operating system 50A or 50B according to this embodiment as compared to the comparative example. As a result, even though the speed V increases toward the rear part of the valve acceleration period as shown by the thin line of FIG. 17, the maximum value of the PV value in the valve operating system 50A or 50B, which is located in the rear part of the valve acceleration period, is reduced as compared to that of the comparative example (broken line), as shown by a bold line in FIG. 16.

In the case of using the structure of the valve operating system 50A including the drive cam 24*a*, the driven member 63, the pivot member 61, the roller 71, and others as described with reference to FIGS. 4 to 6 and FIG. 12, a person skilled in the art can suitably design the positions and shapes of the drive cam 24*a*, the driven member 63, the pivot member 61, and the roller 71 so that the valve maximum acceleration point is located in the front part of the valve acceleration period, the valve maximum acceleration point is located in the front part of the pivot member acceleration period, the acceleration of the valve body 53 is set smaller in the rear part which is rearward relative to the valve maximum acceleration point of the valve acceleration period than in the front part, and the acceleration of the pivot member 61 is set smaller in the rear part which is rearward relative to the pivot member maximum acceleration point in the pivot member acceleration period than in the front part. For example, in the state where the center axis of the drive cam 24*a* and the control shaft 50 are fixed in predetermined positions, the above described lift characteristics and pivot characteristics are attained by suitably designing the shapes of the drive cam 24*a*, the driven member 63 and the pivot member 61. Alternatively, using a simulation program which is commercially available or separately created, a condition of the members for attaining desired lift characteristics and pivot characteristics can be easily determined without manufacturing a trial model. Therefore, the design of the positions and shapes will not be described in detail.

In the manner described above, in the valve operating system 50A or 50B according to this embodiment, the PV value of the contact portions of the drive cam 24*a* and the driven member 63 and the PV value of the contact portions of the pivot member 61 and the valve body 53 (to be precise, tappet 58) are reduced.

[Another Structure of Pivot Cam Mechanism]

Having described the structure of the valve operating system 50A, in which two sets of drive cams 24*a*, driven members 63 and pivot members 61 are provided to correspond to the two intake ports 20A, a different structure may be alternatively used.

Figure 19:
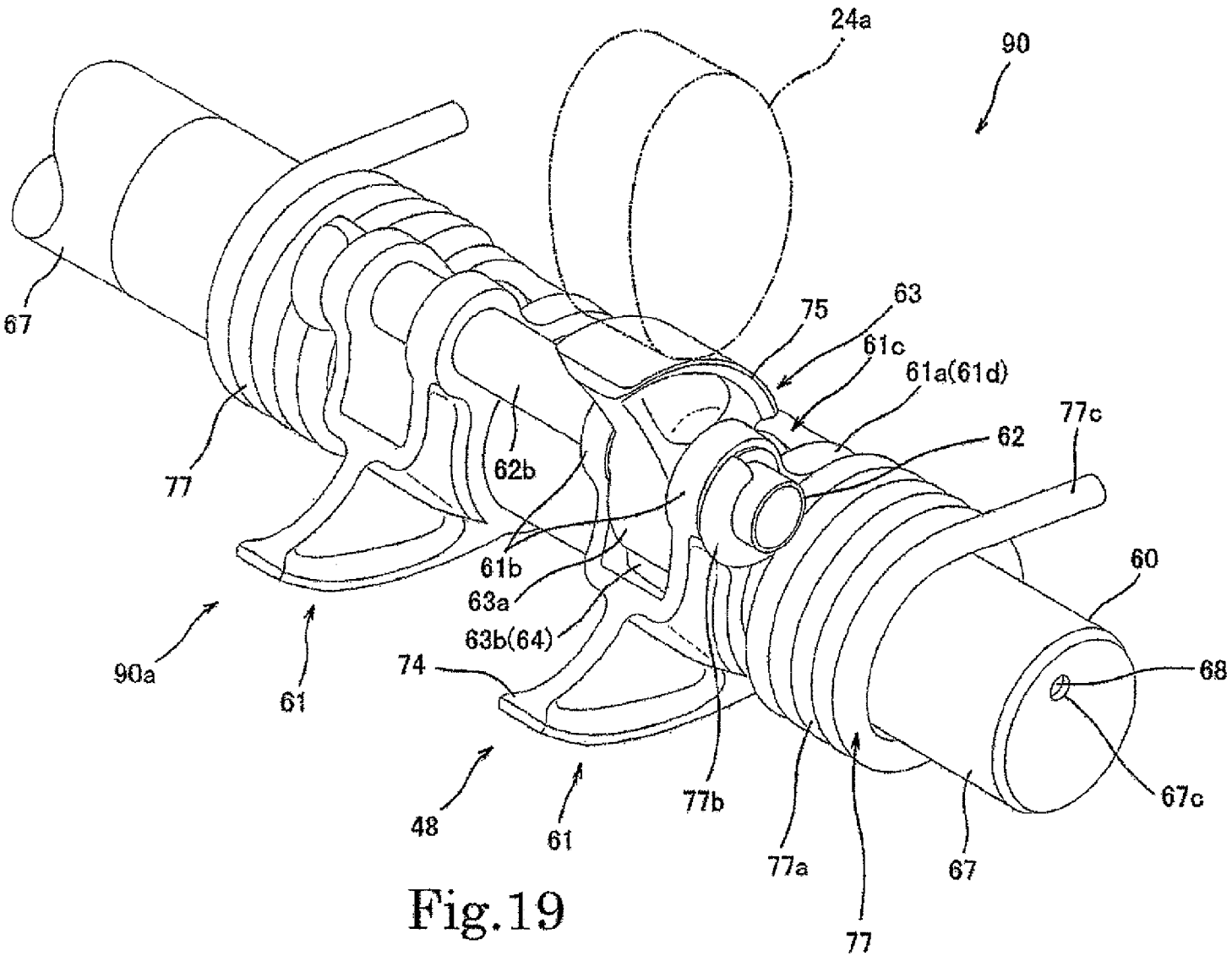
FIG. 19 is a perspective view showing another structure of the pivot cam mechanism which is applicable to the engine of FIG. 1.

FIG. 19 is a perspective view showing another structure of the valve operating system which is applicable to the engine E. As shown in FIG. 19, a valve operating system 90 includes one set of pivot cam mechanism 48 identical to that of Embodiment 1 shown in FIG. 6 and another one set of pivot cam mechanism 90*a* which is different in structure from the pivot cam mechanism 48. To be specific, the pivot cam mechanism 48 including the drive cam 24*a*, the driven member 63, the pivot member 61, the roller 71 (not shown in FIG. 19) and others is provided to correspond to one intake port 20A (see FIG. 3), whereas the pivot cam mechanism 90*a* consisting of the pivot member 61 without the drive cam 24*a*, the driven member 63 and the roller 71, is provided to correspond to the other intake port 20A.

The valve operating system 90 having such a structure is capable of operating as in the above described valve operating system 50A, and of achieving advantages as described above. In the valve operating system 90 shown in FIG. 19, the constituents having the same structures as those of the valve operating system 50A are identified by the same reference numbers and will not be further described.

Figure 20:
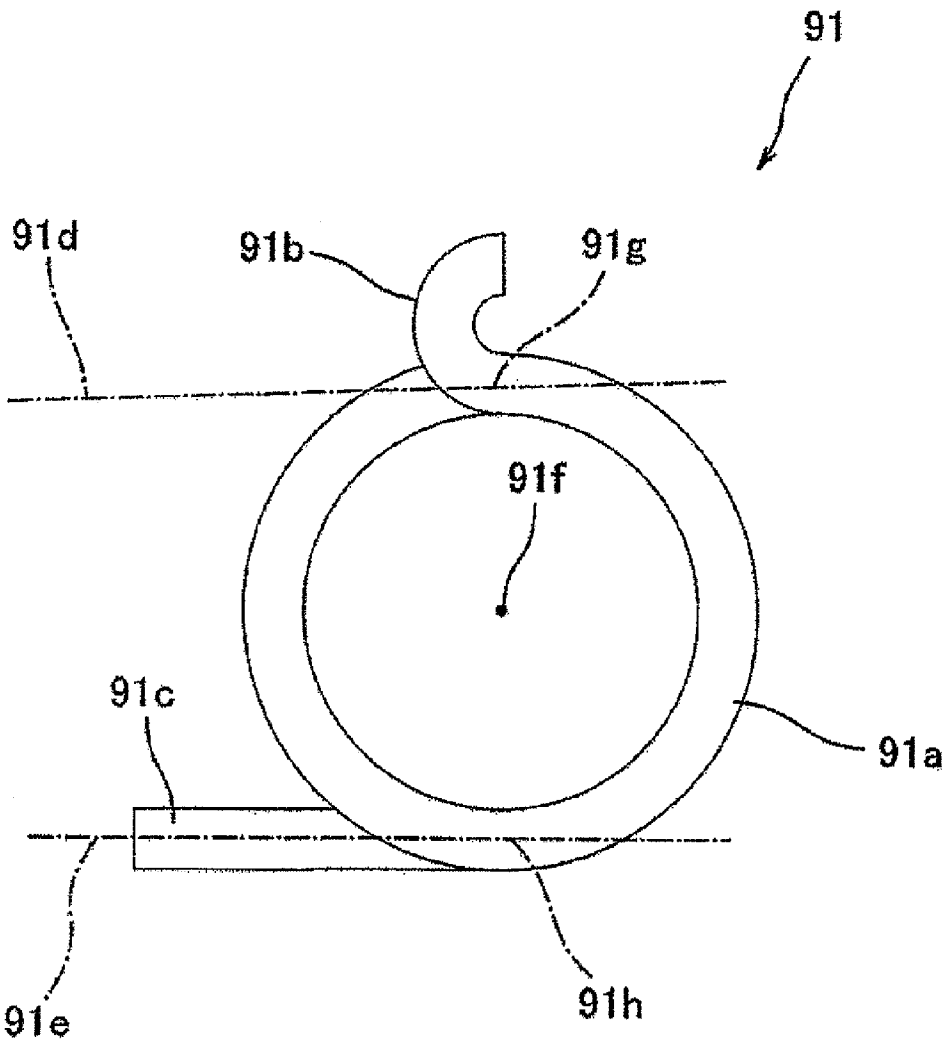
FIG. 20 is a perspective view showing another structure of a coil spring applicable to a pivot cam mechanism according to an embodiment of the present invention.

The coil spring may have a structure different from that of the above described coil spring 77. FIG. 20 is a side view showing another structure of the coil spring which is applicable to the valve operating system 50A or 90. As shown in FIG. 20, a coil spring 91 is formed by winding in close contact a round-rod member which is made of metal and has a predetermined elasticity as in the coil spring 77, and one end 91*b* and an opposite end 91*c* of the round-rod member extends from a winding portion 91*a* forming a wound coil main body. In the coil spring 77, the one end 77*b* and the opposite end 77*c* extend in opposite directions such that they are located on the tangential line contacting the outer peripheral surface of the winding portion 77*a*, whereas the one end 91*b* and the opposite end 91*c* of the coil spring 91 of FIG. 20 extend from two points 91*g* and 91*h* which are located at the opposite sides with respect to a center axis 91*f* of a coil main body 91*a* on the outer periphery of the winding portion 91*a*. To be more specific, the one end 91*b* extends linearly in this embodiment from the point 91*g* along a tangential line 91*d* of the winding portion 91*a* at the point 91*g* as viewed from the direction along the center axis 91*f*. Also, the opposite end 91*c* extends from the point 91*h* in substantially the same direction as the one end 91*b* along a tangential line 91*e* of the winding portion 91*a* at the point 91*h*, and then in the opposite direction in which the winding portion 91*a* is wound.

Figure 21A:
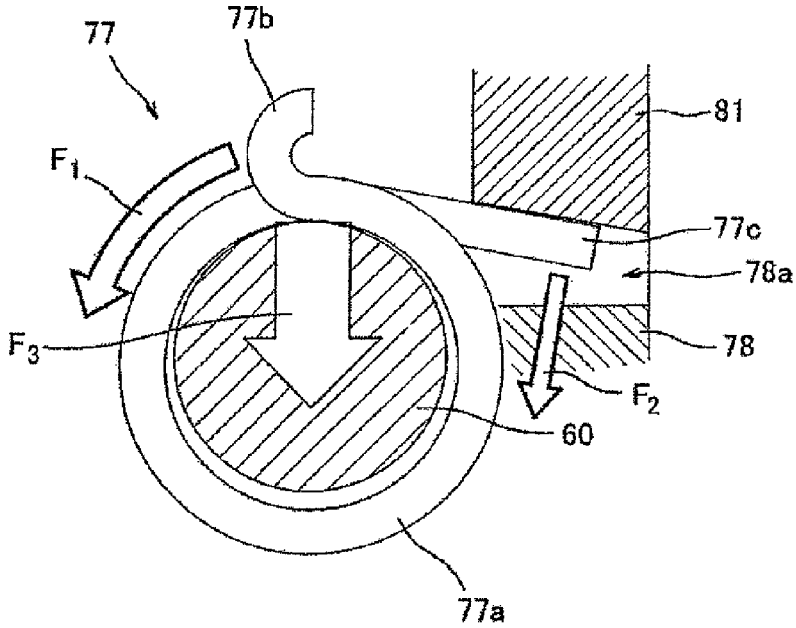
FIG. 21 is a schematic view showing the coil spring of FIG. 20.
Figure 21B:
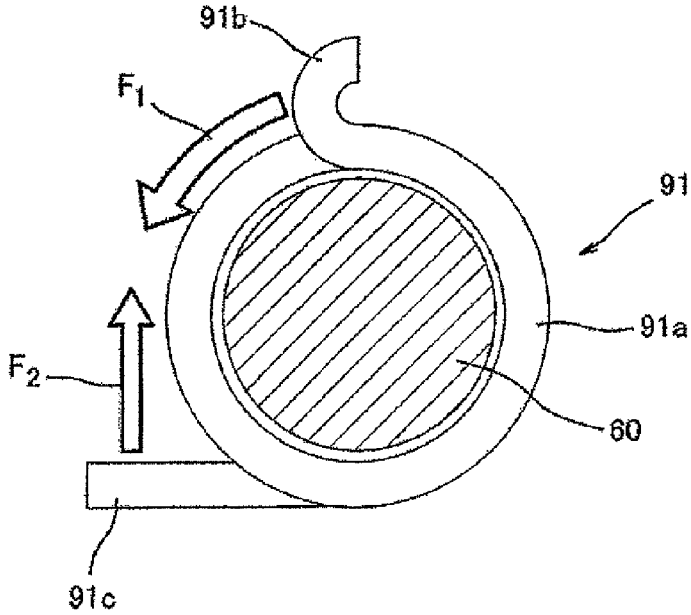

The coil spring 91 having such a structure is capable of reducing the contact pressure generated by the contact of the winding portion 91*a* of the coil spring 91 with the control shaft 60 when the pivot cam mechanism 48 or 90 operates according to the rotation of the drive cam 24*a*. That is, when the pivot cam mechanism 48 or 90 operates, the coil spring 90 generates a restoring force to restore the pivot cam mechanism 48 or 90*a*, while at the same time, drags F1 and F2 against the restoring force are exerted on the one end 91*b* and the opposite end 91*c*, respectively. As shown in FIG. 21(*a*), in the coil spring 77 of FIG. 6 whose one end 77*b* and opposite end 77*c* extend in the opposite direction with respect to the coil main body, the drags F1 and F2 are oriented in substantially the same direction with respect to the coil spring, causing the coil spring to contact the control shaft 60 with a resultant force of F3. On the other hand, in the coil spring 91 whose one end 91*b* and opposite end 91*c* extend in substantially the same direction with respect to the coil main body 91*a*, the drag F1 exerted on the one end 91*b* of the coil spring 91 and the drag F2 exerted on the opposite end 91*c* of the coil spring 91 are oriented in substantially opposite directions and are cancelled, thereby reducing the force generated by contact of the coil spring 91 with the control shaft 60 to less than the resultant force F3, as shown in FIG. 16(*b*).

Having described that the phase changing mechanism 64 includes the roller 71 and the lever portion 63*b* in the pivot cam mechanism 48 or 90*a*, this is exemplary. For example, a follower 63 and the coupling pin 62 may be fixedly coupled and the coupling pin 62 may be configured to be rotatable. Alternatively, the phase of the driven member 63 around the coupling pin 62 may be changed via the gear.

The pivot cam mechanisms 48 and 90*a* may be provided in number to correspond to the intake valve mechanism 51A and the exhaust valve mechanism 51B provided in one cylinder. The present invention is applicable to an engine including one intake valve mechanism 51A and one exhaust valve mechanism 51B in one cylinder, or an engine including three or more intake valve mechanisms 51A and three or more exhaust valve mechanisms 51B in one cylinder.

Figure 22A:
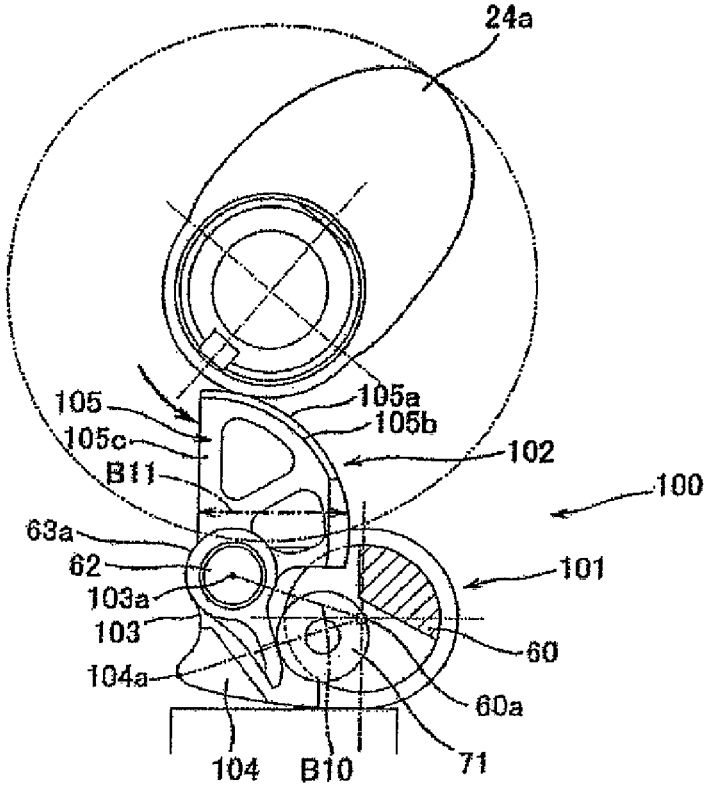
FIG. 22 is a view showing a pivot cam mechanism including a pivot member and a driven member having another structure, wherein FIG. 22(*a*) shows the pivot cam mechanism set in one mode and FIG. 22(*b*) shows the pivot cam mechanism set in another mode.
Figure 22B:
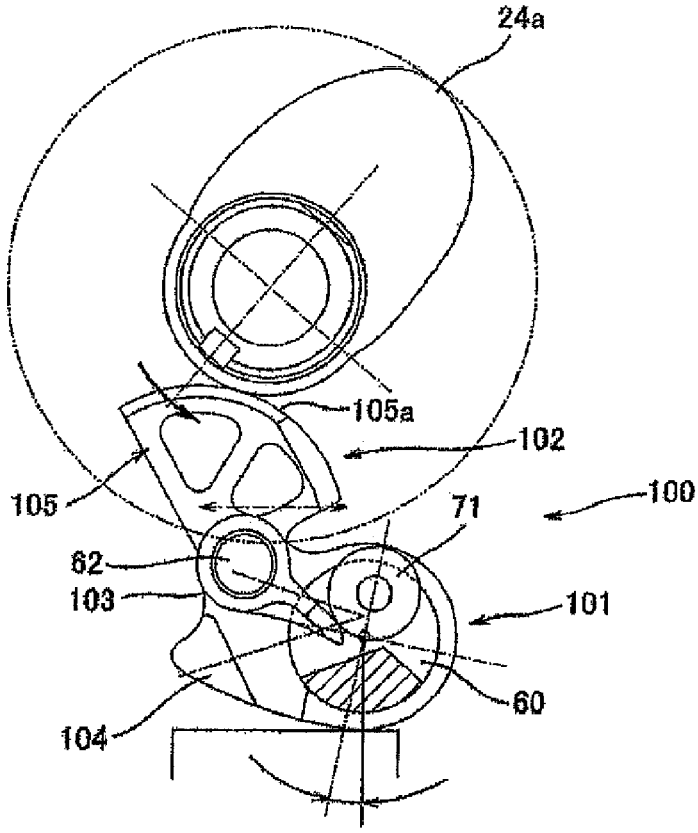
Figure 23A:
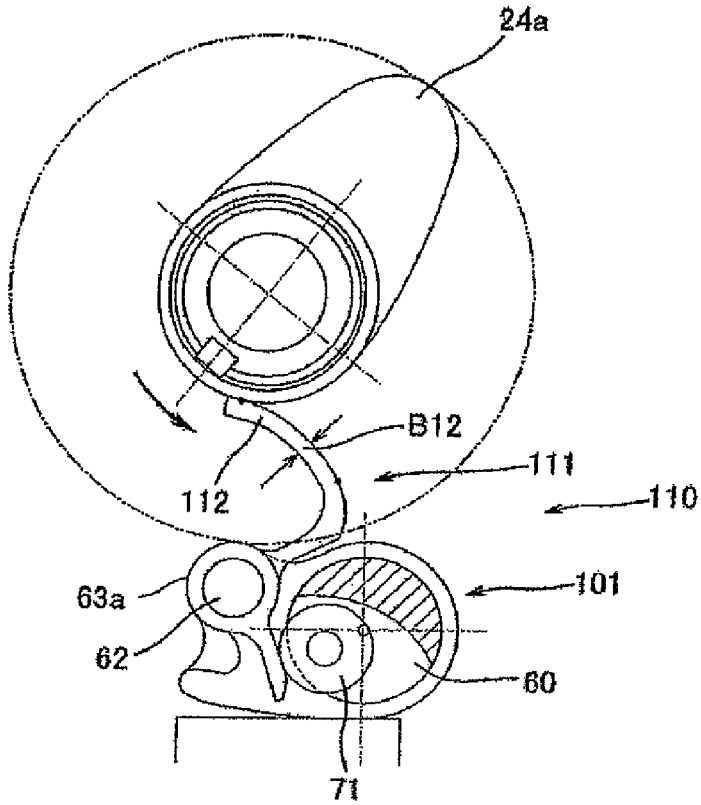
FIG. 23 is a view showing a pivot cam mechanism including a pivot member and a driven member having still another structure, wherein FIG. 23(*a*) shows the pivot cam mechanism set in one mode and FIG. 23(*b*) shows the pivot cam mechanism set in another mode.
Figure 23B:
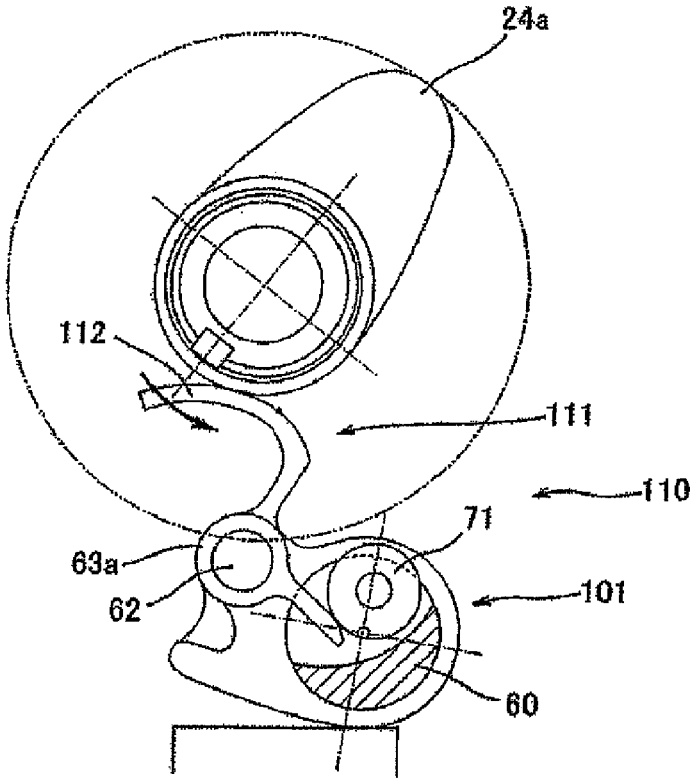
Figure 24A:
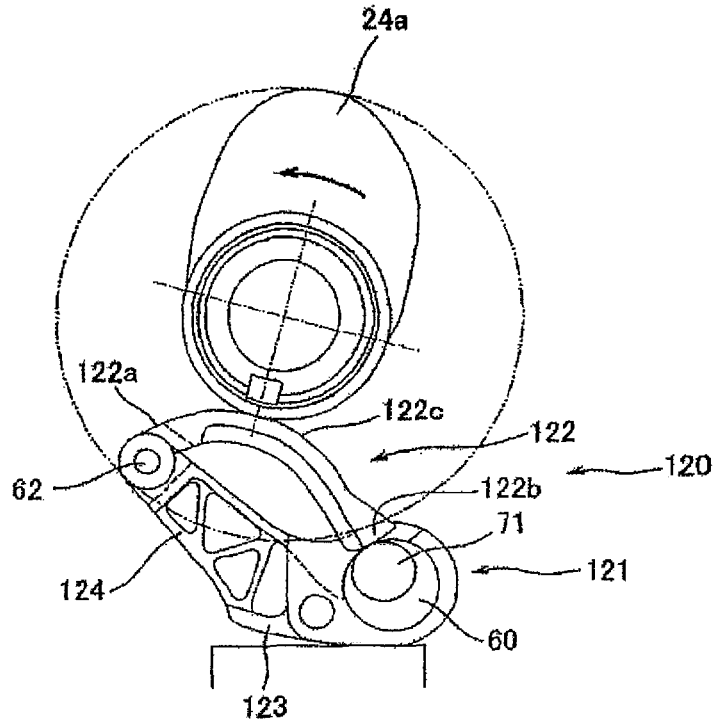
FIG. 24 is a view showing a pivot cam mechanism including a pivot member and a driven member having still another structure, wherein FIG. 24(*a*) shows the pivot cam mechanism set in one mode and FIG. 24(*b*) shows the pivot cam mechanism set in another mode.
Figure 24B:
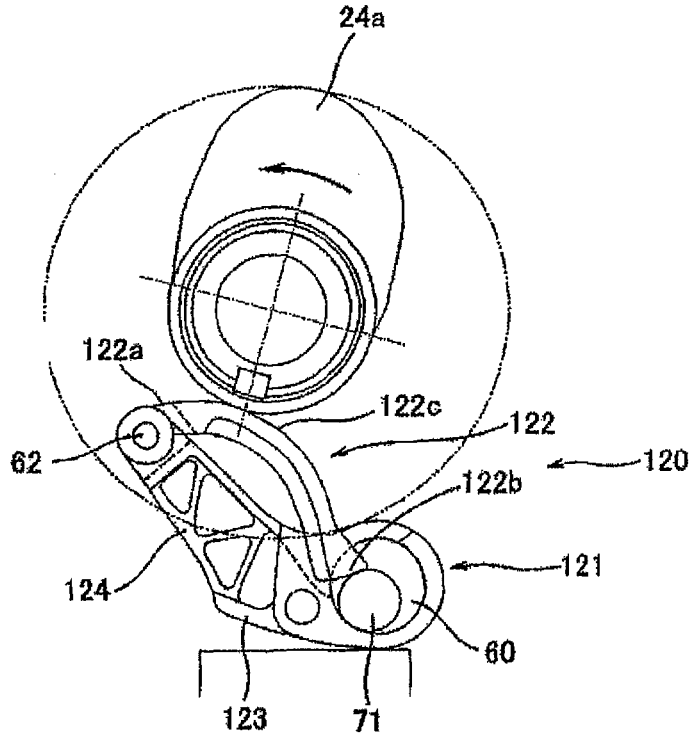

The structure of the pivot member 61 and the structure of the driven member 63 are not limited to the above described structures. FIGS. 22 to 24 are views showing a pivot cam mechanism including a pivot member and a driven member having another structure. FIG. 22(*a*), FIG. 23(*a*), and FIG. 24(*a*) show the pivot cam mechanism set in one mode, and FIG. 22(*b*), FIG. 23(*b*), and FIG. 24(*b*) show the pivot cam mechanism set in another mode. In FIGS. 22 to 24, the same components and members as those of the pivot cam mechanism 48 as described above are identified by the same reference numerals and will not be further described.

A pivot cam mechanism 100 shown in FIG. 22 includes a pivot member 101 and a driven member 101 which are different in structure from the pivot member 61 and the driven member 63 of the pivot cam mechanism 48. To be specific, the pivot member 101 is formed such that a phase difference B10 around the control shaft 60 between a bearing portion 103 supporting the driven member 102 via the coupling pin 62 and a tappet pressing portion 104 is smaller than a phase difference around the control shaft 60 between the bearing portion 61*b* and the tappet pressing portion 74 of the pivot member 48. The driven member 102 is formed such that a maximum width B11 of the drive contact portion 105 is larger than a width of the drive cam contact portion 75 as viewed from the direction along the center axis 60*a*. The meaning of the "phase difference B10 around the control shaft 60 between the bearing portion 103 and the tappet pressing portion 104" is the same as the meaning of the acute angle formed between a line segment connecting a center axis 103*a* of the bearing portion 103 to the center axis 60*a* of the control shaft 60 and a line segment connecting a tip end 104*a* of the tappet pressing portion 104 to the center axis 60*a*.

As shown in FIG. 23, a pivot cam mechanism 110 includes the pivot member 101 having the same structure as that shown in FIG. 22, and a driven member 111 having a structure different from those of the driven members 63 and 101 described above. A drive cam contact portion 112 of the driven member 111 has a predetermined thickness B12 in the direction in which the drive cam contact portion 112 is pressed by the drive cam 24*a* and extends from the insertion portion 63*a* into which the coupling pin 62 is inserted. The drive cam contact portion 112 consists of a sliding contact wall portion 105*b* forming a circular-arc sliding contact surface 105*a* in the drive cam contact portion 105 of the driven member 102 of FIG. 22. That is, a support wall portion 105*c* (see FIG. 17) connecting the sliding contact wall portion 105*b* to the insertion portion 63 is omitted. The driven member 111 having such a structure attains lightweight and can suppress an increase in an inertia moment during the rotation of the drive cam 24*a* as compared to the driven member 102 shown in FIG. 22.

As shown in FIG. 24, a pivot cam mechanism 120 includes a pivot member 121 and a driven member 122. The pivot member 121 includes a tappet pressing portion 123 extending radially outward from an outer fitting tubular portion 61*a* and a bearing portion 124 extending from the tappet pressing portion 123 toward the drive cam 24*a* to support the coupling pin 62 at a tip end portion thereof. The driven member 122 has a circular-arc shape which is curved such that a longitudinal intermediate portion is closer to the drive cam 24*a*. A base end portion 122*a* of the driven member 122 is pivoted to the coupling pin 62, and a tip end portion 122*b* is in contact with the roller 71. A circular-arc sliding contact surface 122*c* which is configured to slidably contact the drive cam 24*a* is formed in the outer peripheral surface of the driven member 122, i.e., the outer surface of the circular arc.

The pivot cam mechanisms 100, 110, and 120 shown in FIGS. 22 to 24 are capable of reducing the inertia moment during the rotation of the drive cam 24*a* by reducing the components and members in number, as in the pivot cam mechanisms 48 and 90*a*.

Figure 25:
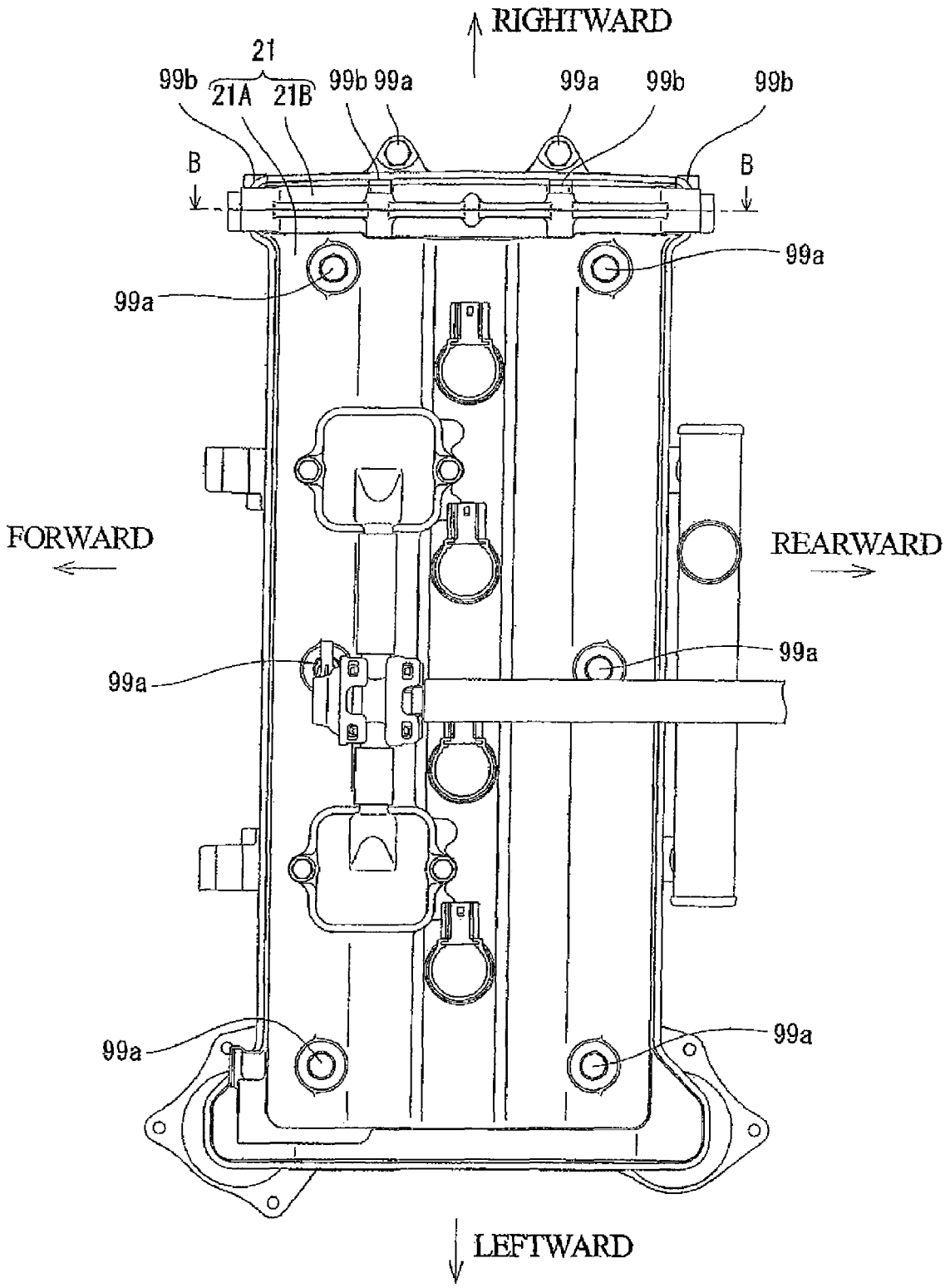
FIG. 25 is a plan view of a cylinder head and a cylinder head cover of the engine E of FIG. 2, as viewed in the direction of arrow A.
Figure 26:
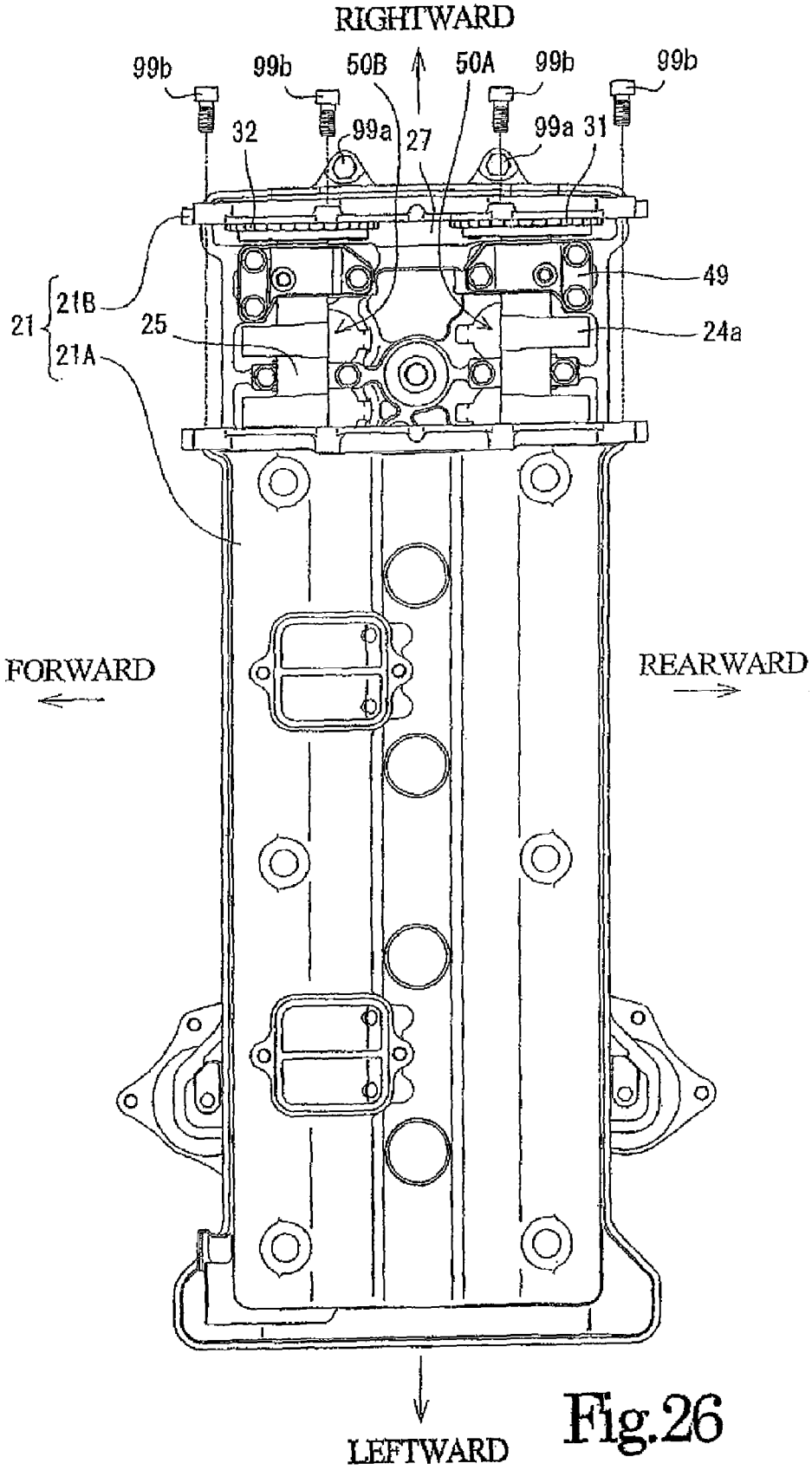
FIG. 26 is a plan view showing a state where a part of the cylinder head cover is moved in the state shown in FIG. 25.

Hereinafter, the cylinder head cover 21 and the cylinder head 20 will be described in detail with reference to FIGS. 25 and 26 as well as the other figures. The cylinder head cover 21 is a casing having a bottomed tubular shape with a rectangular cross section and being open in one direction. The cylinder head cover 21 is dividable in the rightward and leftward direction. In this embodiment, the cylinder head cover 21 is divided into a cam cover 21A and a chain cover 21B at a dividing plane B-B shown in FIG. 25 (see FIG. 27). The cam cover 21A (cam mechanism cover portion) is disposed at the left side of the cylinder head 20 and is configured to cover the drive camshaft 24, the pivot cam mechanism 48 and others. The chain cover 21B (transmission mechanism cover portion) is disposed at the right side of the cylinder head 20 and is configured to cover the rotation transmission mechanism 28.

Figure 27:
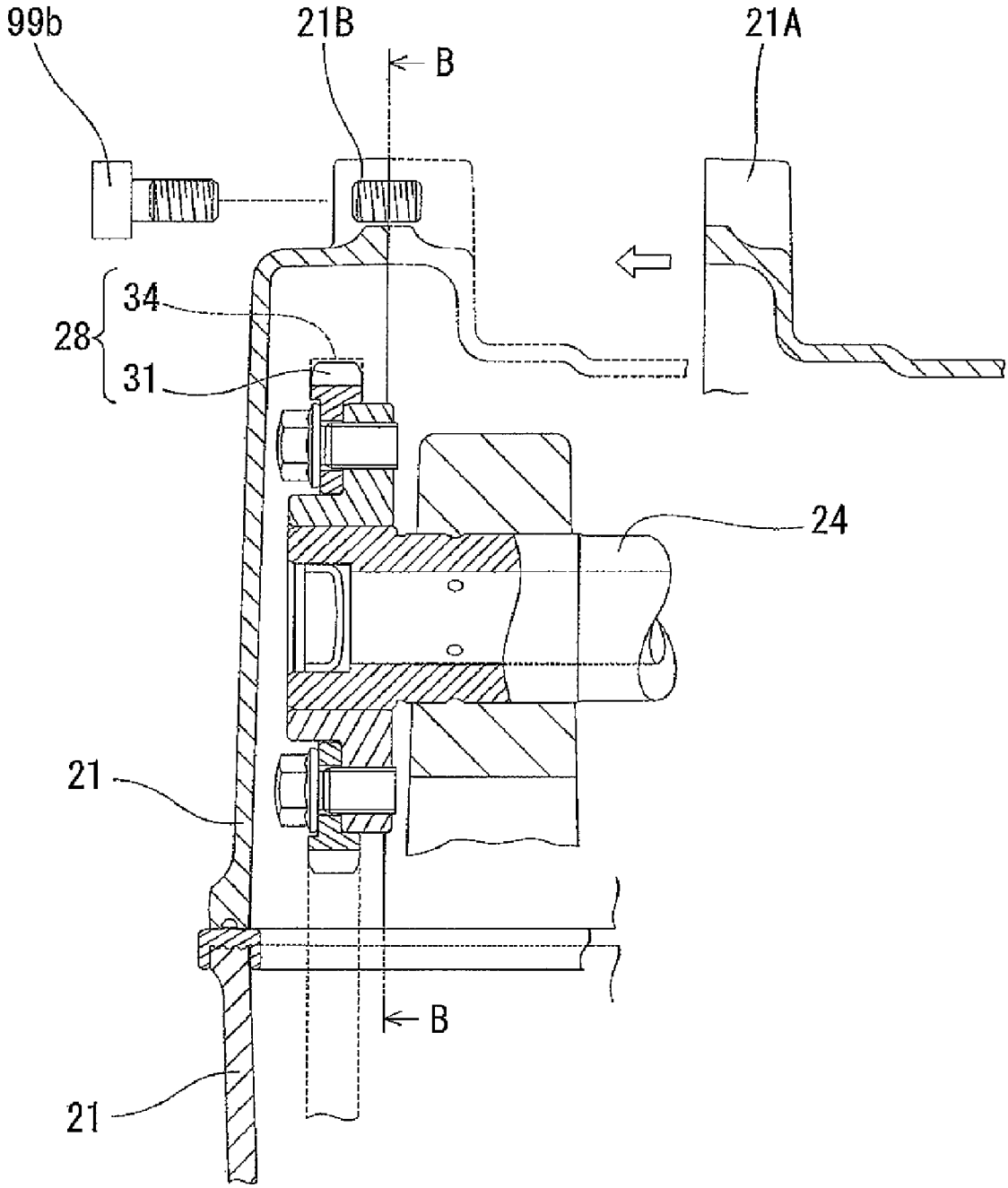
FIG. 27 is an enlarged view showing a region in the vicinity of a dividing plane B-B of the cylinder head cover.

FIG. 27 is an enlarged view showing a region surrounding the dividing plane B-B of the cylinder head cover 21. The dividing plane B-B will be described in detail. As shown in FIG. 9, the dividing plane B-B is a plane passing through the chain tunnel 27. In this embodiment, the dividing plane B-B is located at substantially the center in the vehicle width direction of the chain tunnel 27 and is substantially perpendicular to the rightward and leftward direction. By locating the dividing plane B-B in this position, the cylinder head cover 21 can move without contacting the components and members in the interior of the chain tunnel 27, if the intake cam sprocket 31 and the exhaust cam sprocket 32 are formed to have a larger width, and the portion of the chain tunnel 27 is formed to have a larger width in the forward and leftward direction than the remaining portion.

Figure 28:
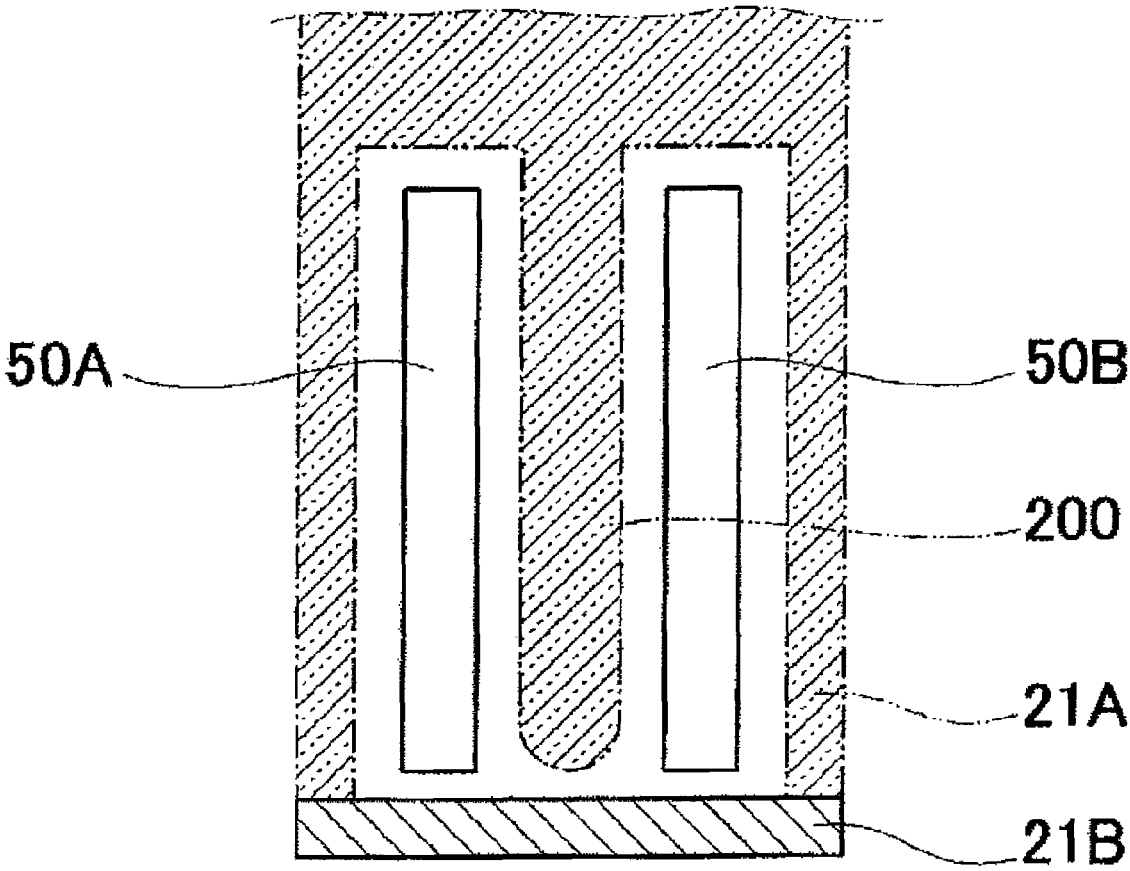
FIG. 28 is a cross-sectional view showing a region where a cam cover of the engine passes when the cam cover is moved in a rightward and leftward direction.

The cam cover 21A has a structure in which front and rear inner walls thereof extend substantially vertically and extend in the rightward and leftward direction. For this reason, when the cam cover 21A is moved to the right or to the left with respect to the cylinder head 20, the inner walls of the cam cover 21A will not contact the built-in components such as the valve operating system. Since the inner walls of the cam cover 21A extend in the rightward and leftward direction and extend vertically, the portion of the inner walls passes through the same region (see region 200 in FIG. 28) when the cam cover 21A is moved to the right or to the left with respect to the cylinder head 20. This can lessen a region where the cam cover 21A passes.

The cam cover 21A of the cylinder head cover 21 having such a structure is fastened to the cylinder head 20 by bolts 99 at six positions which are at right and left sides and at front and rear sides at the center. The chain cover 21B is fastened to the cylinder head 20*a* at a right end portion thereof by bolts 99*a*. The cam cover 21A and the chain cover 21B are fastened such that their end portions which are opposite to each other with respect to the dividing plane B-B are fastened to each other by bolts 99*b* with a seal member interposed therebetween.

Since the covers 21A and 21B are respectively mounted to the cylinder head 20 in the manner described above, one of the covers 21A and 21B can be removed and the other can be kept fastened. There is no need to remove both of the covers 21A and 21B during maintenance. In a mounting operation, one of the covers 21A and 21B can be mounted based on the other which is kept fastened as a reference. Since there is no need to position the covers 21A and 21B together, the mounting operation is facilitated.

Having described the motorcycle 1 as an example in the above described embodiments, the present invention may be applied to valve operating systems used in engines mounted in other vehicles, such as four-wheeled vehicles, small watercraft, or off-road vehicles. In particular, the present invention is suitably applicable to straddle-type vehicles which tend to be smaller than seat-type vehicles. The structure of the valve operating system of the present invention is not limited to the above embodiments. For example, the valve operating system may be used in objects other than vehicles, and change, addition, or deletion of the structure of the valve operating system may be carried out without departing from a scope of the present invention.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A valve operating system of an engine which is configured to change lift characteristics of a valve for opening and closing a port for air-intake or for air-exhaust, comprising:

a drive cam provided at a camshaft which is configured to rotate in association with a crankshaft; and a pivot cam mechanism which is provided between the drive cam and the valve;

wherein the pivot cam mechanism includes:

a pivot member which is angularly displaceably supported by a first support shaft and includes a pressing portion which is configured to press the valve by the angular displacement of the pivot member around the first support shaft, the pivot member causing the valve to reciprocate; and a driven member which is angularly displaceably supported by a second support shaft provided at the pivot member eccentrically from the first support shaft and radially outward relative to and away from the first support shaft and has a sliding contact surface which is configured to slidably contact the drive cam, the driven member being configured to transmit displacement of the drive cam to the pivot member; and wherein the pivot cam mechanism causes the driven member to be angularly displaced around the second support shaft to change relative attitudes of the driven member and the pivot member and causes the pivot member and the driven member to be integrally pivoted around the first support shaft according to rotation of the drive cam.

2. The valve operating system according to claim 1, wherein the second support shaft is eccentric to be closer to the camshaft than the first support shaft.

3. The valve operating system according to claim 1, wherein the pivot cam mechanism further includes a relative attitude changing unit for changing a relative attitude of the driven member with respect to the pivot member;

wherein the relative attitude changing unit includes an eccentric member which is provided eccentrically from a center axis of the first support shaft and is configured to change a phase thereof around the center axis of the first support shaft, and a lever portion which is provided at the driven member and is configured to contact the eccentric member to change a phase of the driven member around a center axis of the second support shaft according to change in the phase of the eccentric member;

and wherein the relative attitude changing unit is configured to change the relative attitude of the driven member with respect to the pivot member according to change in the phase of the eccentric member to change the lift characteristics of the valve which occur according to the rotation of the drive cam.

4. The valve operating system according to claim 3, wherein the pivot cam mechanism includes a shaft angle displacement means configured to be angularly displaced about the first support shaft around the center axis thereof and a biasing means configured to apply a force to the driven member in a direction to cause the sliding contact surface to contact the drive cam.

5. The valve operating system according to claim 3, wherein the eccentric member includes a cylindrical roller and is supported by the first support shaft such that the eccentric member is rotatable around a center axis of the roller.

6. The valve operating system according to claim 3, wherein the pivot member includes two ring-shaped portions which are arranged such that their center axes conform to each other and are rotatably externally fitted to the first support shaft; and wherein the eccentric member is provided to protrude from a peripheral surface of the first support shaft and is disposed between the two ring-shaped portions.

7. The valve operating system according to claim 6, wherein the first support shaft is provided on a peripheral surface thereof with a recess between the two ring-shaped portions, the eccentric member being disposed in the recess, and wherein the lever portion of the driven member is disposed between the two ring-shaped portions.

8. The valve operating system according to claim 1, wherein a coil spring is wound around the first support shaft and is configured to apply a force to the driven member in a direction to cause the sliding contact surface of the driven member to contact the drive cam; and wherein one end of the coil spring is wound around and supported by the second support shaft.

9. The valve operating system according to claim 8, further comprising:

a lower support portion configured to support the first support shaft from below; and an upper support portion which is coupled to the lower support portion from above and supports the camshaft from below such that the camshaft is rotatable;

wherein an opposite end of the coil spring is retained in a recess which is formed between the lower support portion and the upper support portion to so as open outward.

10. The valve operating system according to claim 8, wherein the one end and an opposite end of the coil spring extend from a winding portion forming a coil main body such that the one end and the opposite end extend substantially parallel with each other and toward substantially the same direction.

11. The valve operating system according to claim 8, wherein the engine has a plurality of ports which are aligned; wherein the pivot cam mechanism is provided to correspond to each of the ports;

wherein the driven members included in at least two adjacent pivot cam mechanisms are supported by one second support shaft; and wherein one end of each of the coil springs are wound around and supported by both ends of the second support shaft.

12. The valve operating system according to claim 1, wherein an angle formed between a line segment connecting a rotational center axis of the drive cam to a center of angular displacement of the pivot member and a line segment connecting the rotational center axis of the drive cam to a contact point between the drive cam and the driven member is set to an acute angle.

13. An engine comprising:

the valve operating system as recited in claim 1;

a cylinder head and a cylinder head cover which are arranged in an axial direction of a cylinder, the cylinder head cover being removably attached to the cylinder head;

wherein the cylinder head cover is moved in a direction perpendicular to the axial direction to removably attach the cylinder head cover to the cylinder head.

14. The engine according to claim 13, wherein the cylinder head cover is dividable into one part and the other part in the direction perpendicular to the axial direction.

15. A valve operating system of an engine which is configured to change lift characteristics of a valve for opening and closing a port for air-intake or for air-exhaust, comprising:

a drive cam provided at a camshaft which is configured to rotate in association with a crankshaft; and a pivot cam mechanism which is provided between the drive cam and the valve;

wherein the pivot cam mechanism includes:

a pivot member which is angularly displaceably supported by a first support shaft and includes a pressing portion which is configured to press the valve by angular displacement of the pivot member around the first support shaft, the pivot member causing the valve to reciprocate; and a driven member which is angularly displaceably supported by a second support shaft provided at the pivot member eccentrically from the first support shaft and radially outward relative to and away from the first support shaft and has a sliding contact surface which is configured to slidably contact the drive cam to transmit displacement of the drive cam to the pivot member;

wherein the pivot cam mechanism causes the driven member to be angularly displaced around the second support shaft to change relative attitudes of the driven member and the pivot member and causes the pivot member and the driven member to be integrally pivoted around the first support shaft according to rotation of the drive cam; and wherein a valve maximum acceleration point at which an acceleration of the valve is at a maximum is set in a front half position in a valve acceleration period in which the acceleration of the valve has a positive value while the drive cam is rotating once.

16. The valve operating system according to claim 15, wherein positions and shapes of the drive cam, the driven member, and the pivot member, are designed so that an absolute value of an acceleration change rate of the valve per unit angular displacement of the drive cam is larger in a front part which is forward relative to the valve maximum acceleration point of the valve acceleration period than in a rear part which is rearward relative to the valve maximum acceleration point of the valve acceleration period.

17. The valve operating system according to claim 15, wherein an angle formed between a line segment connecting a rotational center axis of the drive cam to a center of angular displacement of the pivot member and a line segment connecting the rotational center axis of the drive cam to a contact point between the drive cam and the driven member is set to an acute angle.

18. The valve operating system according to claim 15, wherein the set angle is set in a range between 35 degrees and 45 degrees.

19. The valve operating system according to claim 15, wherein the pivot member is one of a plurality of pivot members and the pivot cam mechanism is one of a pair of pivot cam mechanisms respectively provided on an intake port and an exhaust port of the engine, and wherein the pivot cam members included in the pivot cam mechanisms for the intake port and for the exhaust port have an identical shape and respective driven members included in the pivot cam mechanisms for the intake port and for the exhaust port have an identical shape.

20. A valve operating system of an engine which is configured to change lift characteristics of a valve for opening and closing a port for air-intake or for air-exhaust, comprising:

a drive cam provided at a camshaft which is configured to rotate in association with a crankshaft; and a pivot cam mechanism which is provided between the drive cam and the valve;

wherein the pivot cam mechanism includes:

a pivot member which is angularly displaceably supported by a first support shaft and includes a pressing portion which is configured to press the valve by angular displacement of the pivot member around the first support shaft, the pivot member causing the valve to reciprocate; and a driven member which is angularly displaceably supported by a second support shaft provided at the pivot member eccentrically from the first support shaft and radially outward relative to and away from the first support shaft and has a sliding contact surface which is configured to contact the drive cam to transmit displacement of the drive cam to the pivot member;

wherein the pivot cam mechanism causes the driven member to be angularly displaced around the second support shaft to change relative attitudes of the driven member and the pivot member and causes the pivot member and the driven member to be integrally pivoted around the first support shaft according to rotation of the drive cam; and wherein a pivot member maximum acceleration point at which an acceleration of the pivot member is at a maximum is set in a front half position in a pivot member acceleration period in which the acceleration of the pivot member has a positive value while the drive cam is rotating once.

21. The valve operating system according to claim 20, wherein positions and shapes of the drive cam, the driven member, and the pivot member are designed so that the acceleration of the pivot member is substantially zero at a position of the drive cam where a PV value is at a maximum, the PV value being a multiplication value of a surface pressure and a sliding speed at contact portions of the drive cam and the driven member.

* * * * *